US007744186B2

(12) United States Patent
Yoshida et al.

(10) Patent No.: US 7,744,186 B2
(45) Date of Patent: Jun. 29, 2010

(54) RECORDING APPARATUS AND TRANSPORT METHOD

(75) Inventors: Masahiko Yoshida, Shiojiri (JP); Tatsuya Nakano, Hata-machi (JP); Hirokazu Nunokawa, Matsumoto (JP); Bunji Ishimoto, Matsumoto (JP); Toru Miyamoto, Shiojiri (JP); Yoichi Kakehashi, Nagoya (JP)

(73) Assignee: Seiko Epson Corporation, Tokyo (JP)

( * ) Notice: Subject to any disclaimer, the term of this patent is extended or adjusted under 35 U.S.C. 154(b) by 559 days.

(21) Appl. No.: 11/765,227

(22) Filed: Jun. 19, 2007

(65) Prior Publication Data

US 2008/0007586 A1 Jan. 10, 2008

(30) Foreign Application Priority Data

Jun. 20, 2006 (JP) ..... 2006-170161
May 25, 2007 (JP) ..... 2007-139347

(51) Int. Cl.
*B41J 29/38* (2006.01)

(52) U.S. Cl. ..... 347/16

(58) Field of Classification Search ..... 347/16
See application file for complete search history.

(56) References Cited

U.S. PATENT DOCUMENTS 6,101,426 A * 8/2000 Kimura et al. ..... 271/265.01
6,568,784 B2 * 5/2003 Izumi et al. ..... 347/19

FOREIGN PATENT DOCUMENTS

JP 5-96796 A 4/1993

* cited by examiner

*Primary Examiner*—Julian D Huffman
(74) *Attorney, Agent, or Firm*—Sughrue Mion, PLLC

(57) ABSTRACT

A recording apparatus of this invention includes a head; a transport mechanism that transports a medium in a transport direction with respect to the head, according to a target transport amount to be targeted; a memory that stores a plurality of correction values associated with a relative position of the head and the medium; and a controller that controls the transport mechanism based on the target transport amount that has been corrected, after correcting the target transport amount based on correction values, which are in number according to a size of the target transport amount, and which include the correction value according to the relative position when transporting by the target transport amount.

18 Claims, 22 Drawing Sheets

| CORRECTION VALUE | BORDER POSITION INFORMATION |
|---|---|
| Ca(1) | LOGIC POSITION CORRESPONDING TO L2 |
| Ca(2) | LOGIC POSITION CORRESPONDING TO L3 |
| Ca(3) | LOGIC POSITION CORRESPONDING TO L4 |
| ⋮ | ⋮ |
| Ca(19) | LOGIC POSITION CORRESPONDING TO L20 |
| Cb | — |

RECORDING APPARATUS AND TRANSPORT METHOD

CROSS-REFERENCE TO RELATED APPLICATIONS

The present application claims priority upon Japanese Patent Application No. 2006-170161 filed on Jun. 20, 2006 and Japanese Patent Application No. 2007-139347 filed on May 25, 2007 which are herein incorporated by reference.

BACKGROUND

1. Technical Field

The present invention relates to recording apparatuses and transport methods.

2. Related Art

Inkjet printers are known as recording apparatuses in which a medium (such as paper or cloth for example) is transported in a transport direction and recording is carried out on the medium by a head. In such a recording apparatus, when a transport error occurs while transporting the medium, the head cannot record on a correct position on the medium. In particular, with inkjet printers, when ink droplets do not land in the correct position on the medium, there is a risk that white streaks or black streaks will occur in the printed image and image quality deteriorates.

Accordingly, methods are proposed for correcting transport amounts of the medium. For example, in JP-A-5-96796 it is proposed that a test pattern is printed and the test pattern is read, and correction values are calculated based on a reading result such that when an image is to be recorded, the transport amounts are corrected based on the calculated values.

In JP-A-5-96796, it is assumed that recording is performed with a fixed transport amount. Therefore, in JP-A-5-96796, each correction value is associated with a specific transport movement, and when performing a certain transport movement, the correction value that is associated with that transport movement is applied as is.

However, in the method in JP-A-5-96796, the transport amount cannot be changed, and there are a lot of restrictions.

SUMMARY

An object of the present invention is to be able to perform correction of a transport amount in a state with little restrictions.

A primary aspect of the invention for achieving the above-described object is a recording apparatus including:

a head;

a transport mechanism that transports a medium in a transport direction with respect to the head, according to a target transport amount to be targeted;

a memory that stores a plurality of correction values associated with a relative position of the head and the medium; and a controller that controls the transport mechanism based on the target transport amount that has been corrected, after correcting the target transport amount based on correction values, which are in number according to a size of the target transport amount, and which include the correction value according to the relative position when transporting by the target transport amount.

Other features of the invention will become clear through the accompanying drawings and the following description.

DESCRIPTION OF EMBODIMENTS

Figure 1:
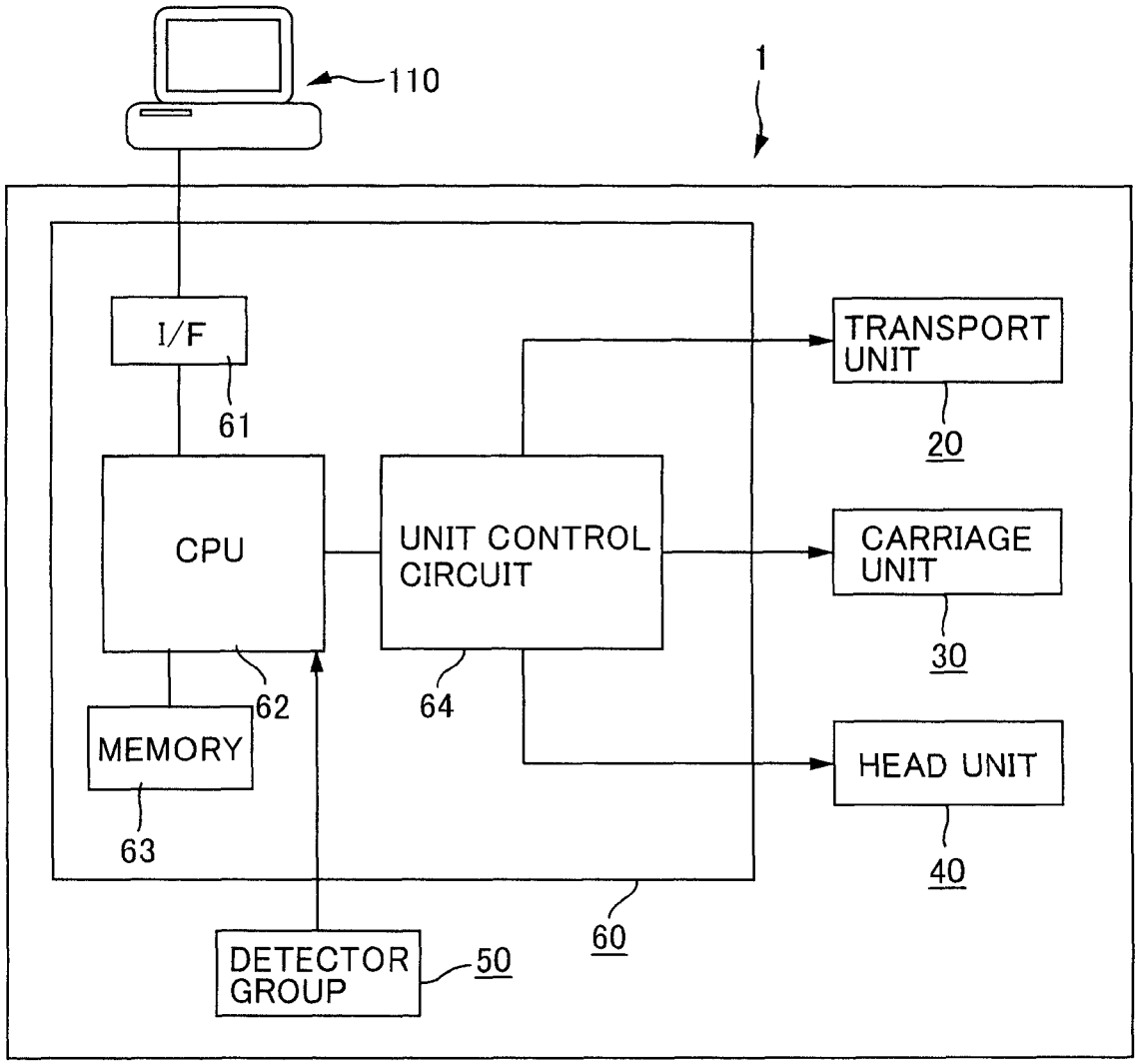
FIG. 1 is a block diagram of an overall configuration of a printer 1.

At least the following matters will be made clear by the explanation in the present specification and the description of the accompanying drawings.

A recording apparatus is made clear including:

a head;

a transport mechanism that transports a medium in a transport direction with respect to the head, according to a target transport amount to be targeted;

a memory that stores a plurality of correction values associated with a relative position of the head and the medium; and a controller that controls the transport mechanism based on the target transport amount that has been corrected, after correcting the target transport amount based on correction values, which are in number according to a size of the target transport amount, and which include the correction value according to the relative position when transporting by the target transport amount.

With this recording apparatus, accurate corrections can be performed according to the transport amount on the transport error that changes according to the relative position of the head and the medium.

Further, it is preferable that each correction value is associated with a range of the relative position to be applied with that correction value, and in a case where the range of the correction value corresponding to the relative position before transport is exceeded when transporting by the target transport amount, the controller corrects the target transport amount, based on the correction value corresponding to the relative position before transport and the correction value corresponding to the relative position after transport. Further, it is preferable that each correction value is associated with a range of the relative position to be applied with that correction value, and the controller corrects the target transport amount by assigning weights to the correction value according to a ratio of a range of the relative position that changes when transporting by the target transport amount to the range of the relative position to be applied with the correction value. With this recording apparatus, accurate corrections can be performed according to the transport error that changes according to the relative position of the head and the medium.

Further, it is preferable that the transport mechanism has a transport roller, and transports the medium in the transport direction by rotating the transport roller, each correction value is determined based on a transport error when transporting the medium by making the transport roller rotate by one rotation, and a range of the relative position to be applied with the correction value corresponds to a transport amount when transporting the medium by making the transport roller rotate by a rotation amount of less than one rotation. In this way, fine corrections can be performed on the transport error according to the relative position.

Further, it is preferable that the transport mechanism has a transport roller, and transports the medium in the transport direction by making the transport roller rotate, before the correction value is stored in the memory, the controller prints a first pattern on a medium, prints a second pattern after transporting the medium by making the transport roller rotate by a rotation amount of less than one rotation from a rotating position of the transport roller at the time of printing the first pattern, prints a third pattern after transporting the medium by making the transport roller rotate by a rotation amount of one rotation from a rotating position of the transport roller at the time of printing the first pattern, and prints a fourth pattern after transporting the medium by making the transport roller rotate by a rotation amount of one rotation from a rotating position of the transport roller at the time of printing the second pattern, the memory stores a first correction value that has been determined based on the first pattern and the third pattern, and a second correction value that has been determined based on the second pattern and the fourth pattern, after the correction values have been stored in the memory, the controller transports a medium by correcting the target transport amount based on the first correction value, when a relative position of the medium with respect to the transport roller is in a predetermined range between the relative position at the time of printing the first pattern and the relative position at the time of printing the third pattern, and transports a medium by correcting the target transport amount based on the second correction value, in a state where a transport roller has been made to rotate by a rotation amount of less than one rotation from when a relative position of a medium with respect to the transport roller is in the predetermined range. Thus, more correction values can be obtained, and fine corrections can be performed on the transport error.

Furthermore, it is preferable that the first pattern to the fourth pattern are formed using a same nozzle among a plurality of nozzles that move in a movement direction. In this way, accurate corrections can be performed on the DC component transport error.

A transport method is made clear that transports a medium by correcting a target transport amount to be targeted based on a correction value, the transport method including:

a step of storing in advance in a memory a plurality of correction values each associated with a relative position of the head and the medium;

a step of correcting a target transport amount based on correction values, which are in number according to a size of the target transport amount, and which include the correction value according to the relative position when transporting by the target transport amount; and a step of transporting the medium based on the target transport amount that has been corrected.

With this transport method, accurate corrections can be performed according to the transport amount on the transport error that changes according to the relative position of the head and the medium.

A transport method is made clear that transports a medium after correcting a target transport amount to be targeted based on a correction value, the transport method including:

a step of calculating a plurality of correction values each associated with a relative position of the head and the medium;

a step of storing in a memory correction values each associated with a target transport amount, by calculating the correction values, with respect to each target transport amount of a plurality of target transport amounts set in advance, based on the correction values, which are in number according to a size of the target transport amount, and which include the correction value according to the relative position when transporting by that target transport amount;

a step of correcting the target transport amount based on the correction value corresponding to the target transport amount, when transporting by that target transport amount; and transporting the medium based on the target transport amount that has been corrected.

With this transport method, accurate corrections can be performed according to the transport amount on the transport error that changes according to the relative position of the head and the medium.

Configuration of the Printer

Regarding the Configuration of the Inkjet Printer

Figure 2A:
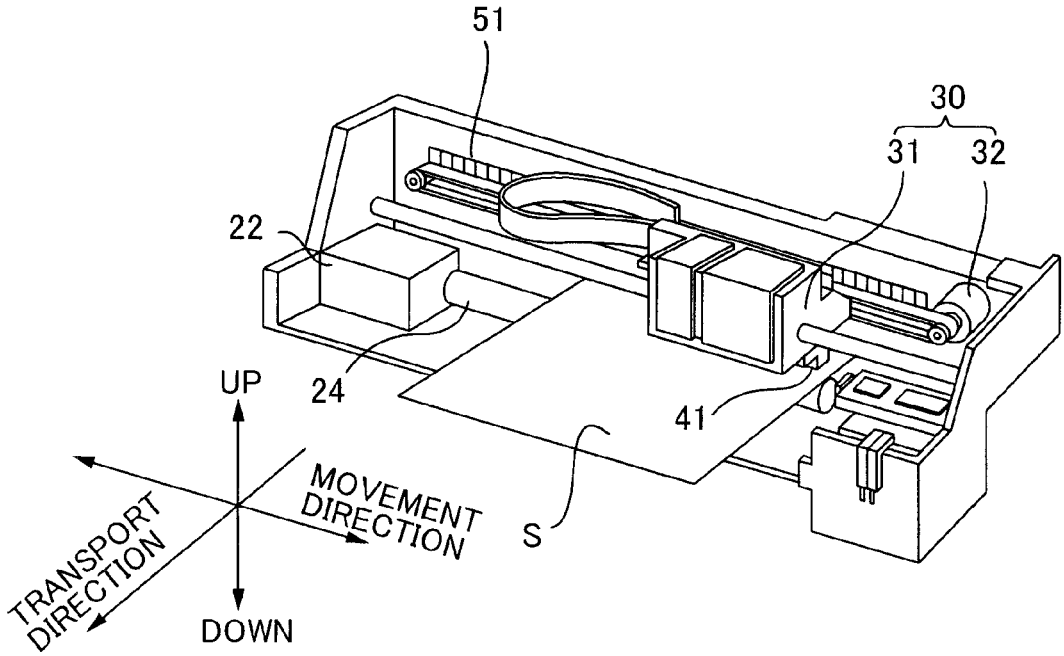
FIG. 2A is a schematic view of the overall configuration of the printer 1.
Figure 2B:
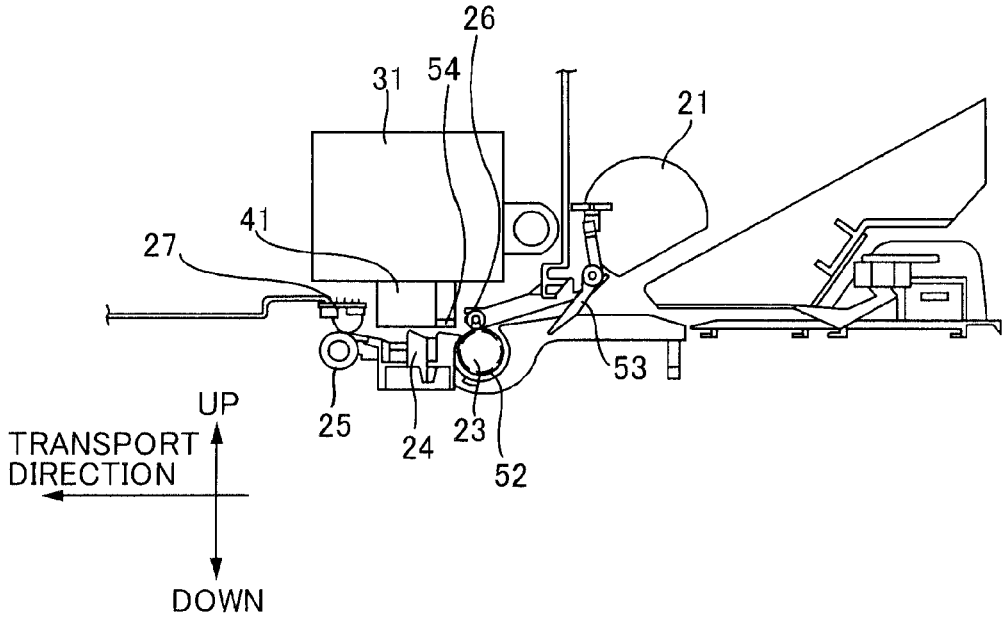
FIG. 2B is a cross sectional view of the overall configuration of the printer 1.

FIG. 1 is a block diagram of an overall configuration of a printer 1. FIG. 2A is a schematic diagram showing the overall configuration of the printer 1. Furthermore, FIG. 2B is a cross sectional view of the overall configuration of the printer 1. The basic configuration of the printer is described below.

The printer 1 has a transport unit 20, a carriage unit 30, a head unit 40, a detector group 50, and a controller 60. The printer 1 receives print data from a computer 110, which is an external device, and controls the various units (the transport unit 20, the carriage unit 30, and the head unit 40) through the controller 60. The controller 60 controls these units based on the print data received from the computer 110 to print an image on the paper. The detector group 50 monitors the conditions within the printer 1, and outputs the detection results to the controller 60. The controller 60 controls these units based on the detection results received from the detector group 50.

The transport unit 20 is for transporting a medium (for example, such as paper S) in a predetermined direction (hereinafter, referred to as a "transport direction"). The transport unit 20 has a paper feed roller 21, a transport motor 22 (also referred to as PF motor), a transport roller 23, a platen 24, and a paper discharge roller 25. The paper feed roller 21 is a roller for feeding paper that has been inserted into a paper insert opening into the printer. The transport roller 23 is a roller for transporting a paper S that has been supplied by the paper feed roller 21 up to a printable region, and is driven by the transport motor 22. The platen 24 supports the paper S being printed. The paper discharge roller 25 is a roller for discharging the paper S outside the printer, and is provided on the downstream side in the transport direction with respect to the printable area. The paper discharge roller 25 is rotated in synchronization with the transport roller 23.

It should be noted that when the transport roller 23 transports the paper S, the paper S is sandwiched between the transport roller 23 and a driven roller 26. In this way, the posture of the paper S is kept stable. On the other hand, when the paper discharge roller 25 transports the paper S, the paper S is sandwiched between the paper discharge roller 25 and a driven roller 27. The discharge roller 25 is provided on a downstream side from the printable region in the transport direction and therefore the driven roller 27 is configured so that its contact surface with the paper S is small (see FIG. 4). For this reason, when the lower end of the paper S passes through the transport roller 23 and the paper S is transported by the paper discharge roller 25 only, the posture of the paper S tends to become unstable, which also tends to make the transport characteristics fluctuate.

The carriage unit 30 is for making the head move (also referred to as "scan") in a predetermined direction (hereinafter, referred to as the "movement direction"). The carriage unit 30 has a carriage 31 and a carriage motor 32 (also referred to as "CR motor"). The carriage 31 can be moved back and forth in the moving direction, and is driven by the carriage motor 32. The carriage 31 detachably holds ink cartridges that contain ink.

The head unit 40 is for ejecting ink onto paper. The head unit 40 has a head 41 including a plurality of nozzles. The head 41 is provided in the carriage 31 so that when the carriage 31 moves in the movement direction, the head 41 also moves in the movement direction. Dot lines (raster lines) are formed on the paper in the movement direction due to the head 41 intermittently ejecting ink while moving in the movement direction.

The detector group 50 includes a linear encoder 51, a rotary encoder 52, a paper detection sensor 53, and an optical sensor 54, and the like. The linear encoder 51 is for detecting the position of the carriage 31 in the movement direction. The rotary encoder 52 is for detecting the amount of rotation of the transport roller 23. The paper detection sensor 53 detects the position of the front end of the paper that is being fed. The optical sensor 54 detects whether or not the paper is present, through its light-emitting section and a light-receiving section provided to the carriage 31. The optical sensor 54 can also detect the width of the paper by detecting the position of the end portions of the paper while being moved by the carriage 31. Depending on the circumstances, the optical sensor 54 can also detect the front end of the paper (the end portion at the transport direction downstream side; also referred to as the upper end) and the rear end of the paper (the end portion on the transport direction upstream side; also referred to as the lower end).

The controller 60 is a control unit (controller) for carrying out control of the printer. The controller 60 has an interface section 61, a CPU 62, a memory 63, and a unit control circuit 64. The interface section 61 exchanges data between the computer 110, which is an external device, and the printer 1. The CPU 62 is an arithmetic processing device for carrying out overall control of the printer. The memory 63 is for ensuring a working area and a storage area for the programs for the CPU 62, for instance, and includes storage devices such as a RAM or an EEPROM. The CPU 62 controls the various units via the unit control circuit 64 in accordance with programs stored in the memory 63.

Regarding the Nozzles

Figure 3:
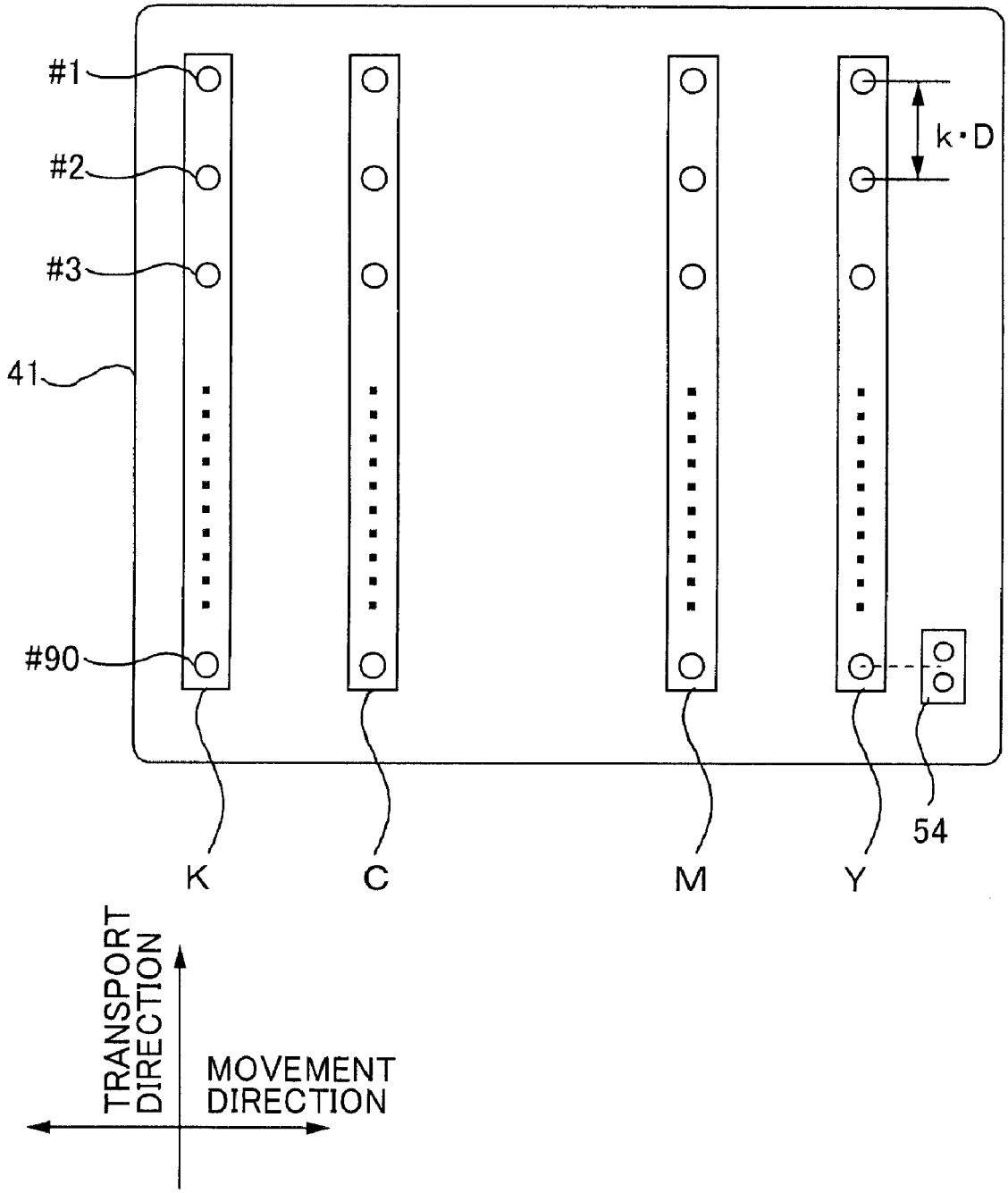
FIG. 3 is an explanatory diagram showing an arrangement of the nozzles.

FIG. 3 is an explanatory diagram showing the arrangement of the nozzles in the lower face of the head 41. A black ink nozzle group K, a cyan ink nozzle group C, a magenta ink nozzle group M, and a yellow ink nozzle group Y are formed in the lower face of the head 41. Each nozzle group is provided with 90 nozzles, which are ejection openings for ejecting ink of the respective colors.

The plurality of nozzles of each of the nozzle groups are arranged in rows at a constant spacing (nozzle pitch: k·D) in the transport direction. Here, D is the minimum dot pitch in the transport direction (that is, the spacing between dots formed on the paper S at maximum resolution). Also, k is an integer of 1 or more. For example, if the nozzle pitch is 90 dpi (1/90 inch), and the dot pitch in the transport direction is 720 dpi (1/720), then k=8.

Each nozzle of each of the nozzle groups is assigned a number (#1 to #90) that becomes smaller as the nozzle is arranged more downstream. That is, the nozzle #1 is positioned more downstream in the transport direction than the nozzle #90. Also, the optical sensor 54 described above is provided substantially to the same position as the nozzle #90, which is on the most upstream side regarding its position in the paper transport direction.

Each nozzle is provided with an ink chamber (not shown) and a piezo element. Driving the piezo element causes the ink chamber to expand and contract, thereby ejecting an ink droplet from the nozzle.

Transport Error

Regarding Transport of the Paper

Figure 4:
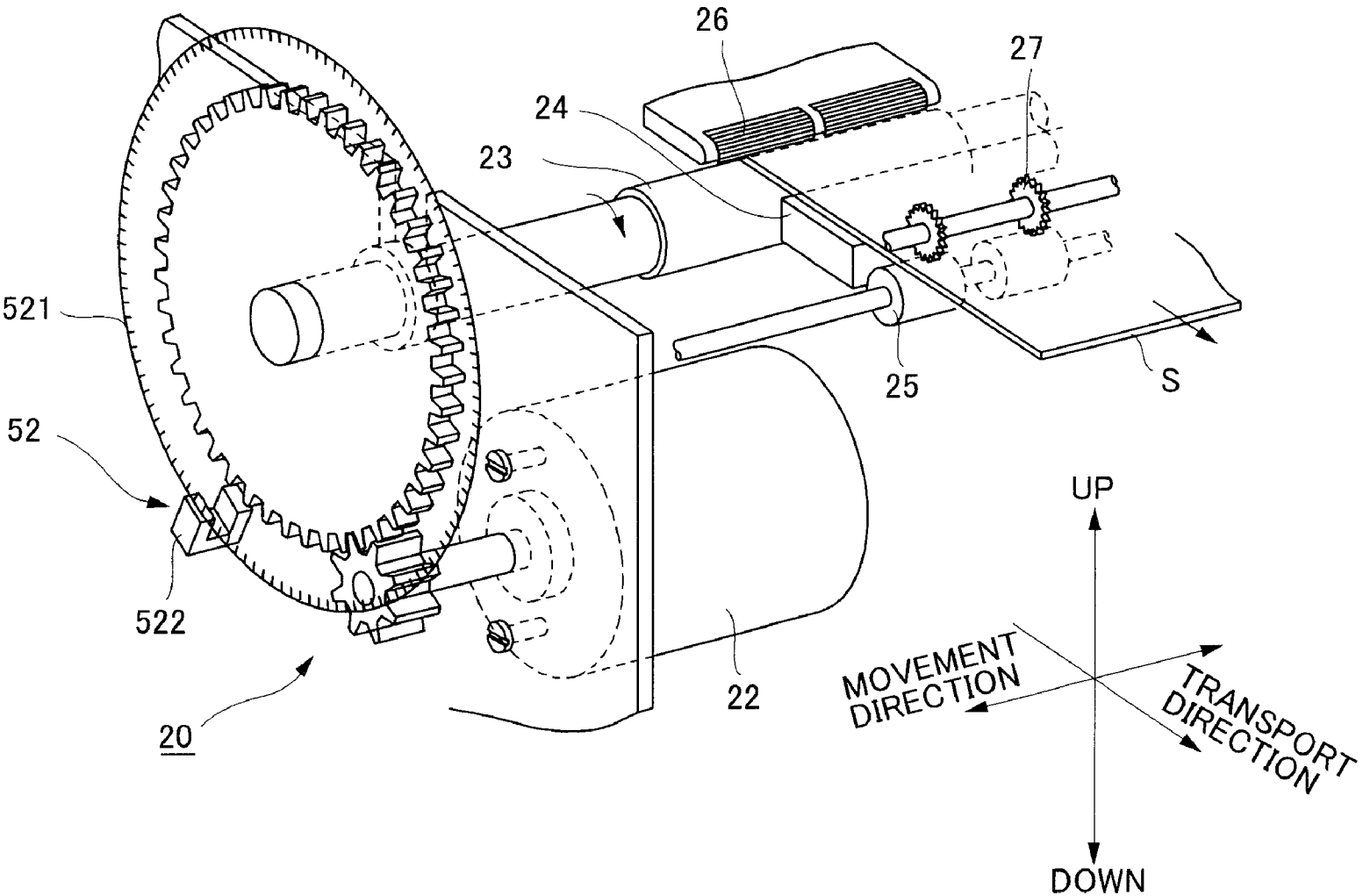
FIG. 4 is an explanatory diagram of a configuration of the transport unit 20.

FIG. 4 is an explanatory diagram of a configuration of the transport unit 20.

The transport unit 20 drives the transport motor 22 by predetermined drive amounts in accordance with a transport command from the controller 60. The transport motor 22 generates a drive force in the rotation direction that corresponds to the drive amount that has been ordered. The transport motor 22 then rotates the transport roller 23 using this drive force. That is, when the transport motor 22 generates a predetermined drive amount, the transport roller 23 is rotated by a predetermined rotation amount. When the transport roller 23 rotates by the predetermined rotation amount, the paper is transported by a predetermined transport amount.

The amount by which the paper is transported is determined according to the rotation amount of the transport roller 23. In the present embodiment, when the transport roller 23 performs one rotation, the paper is transported by one inch (that is, the circumference of the transport roller 23 is one inch). Thus, when the transport roller 23 rotates one quarter, the paper is transported by ¼ inch.

Consequently, if the rotation amount of the transport roller 23 can be detected, it is also possible to detect the transport amount of the paper. Accordingly, the rotary encoder 52 is provided in order to detect the rotation amount of the transport roller 23.

The rotary encoder 52 has a scale 521 and a detection section 522. The scale 521 has numerous slits provided at a predetermined spacing. The scale 521 is provided on the transport roller 23. That is, the scale 521 rotates together with the transport roller 23 when the transport roller 23 is rotated. Then, when the transport roller 23 rotates, each slit on the scale 521 successively passes through the detection section 522. The detection section 522 is provided in opposition to the scale 521, and is fastened on the main printer unit side. The rotary encoder 52 outputs a pulse signal each time a slit provided in the scale 521 passes through the detection section 522. Since the slits provided in the scale 521 successively pass through the detection section 522 according to the rotation amount of the transport roller 23, the rotation amount of the transport roller 23 is detected based on the output of the rotary encoder 52.

Then, when the paper is to be transported by a transport amount of one inch for example, the controller 60 drives the transport motor 22 until the rotary encoder 52 detects that the transport roller 23 has performed one rotation. In this manner, the controller 60 drives the transport motor 22 until a transport amount corresponding to a targeted transport amount (target transport amount) is detected by the rotary encoder 52 such that the paper is transported by the target transport amount.

Regarding Transport Error

In this regard, the rotary encoder 52 directly detects the rotation amount of the transport roller 23, and strictly speaking, is not detecting the transport amount of the paper S. For this reason, when the rotation amount of the transport roller 23 and the transport amount of the paper S do not match, the rotary encoder 52 cannot accurately detect the transport amount of the paper S, and a transport error (detection error) occurs. There are two types of transport error, DC component transport error and AC component transport error.

DC component transport error refers to a predetermined amount of transport error produced when the transport roller has performed one rotation. It is conceived that the DC component transport error is caused by the circumference of the transport roller 23 being different in each individual printer due to deviation in production and the like. In other words, the DC component transport error is a transport error that occurs because of the difference between the circumference of the transport roller 23 in design and the actual circumference of the transport roller 23. The DC component transport error is constant regardless of the commencement position when the transport roller 23 performs one rotation. However, due to the effect of paper friction and the like, the actual DC component transport error is a value that varies in response to a total transport amount of the paper (discussed later). In other words, the actual DC component transport error is a value that varies in response to the relative positional relationship between the paper S and the transport roller 23 (or the paper S and the head 41).

The AC component transport error refers to transport error corresponding to a location on a circumferential surface of the transport roller that is used when transporting. The AC component transport error is an amount that varies in response to the location on the circumferential surface of the transport roller that is used when transporting. That is, the AC component transport error is an amount that varies in response to the rotation position of the transport roller when transport commences and the transport amount.

Figure 5:
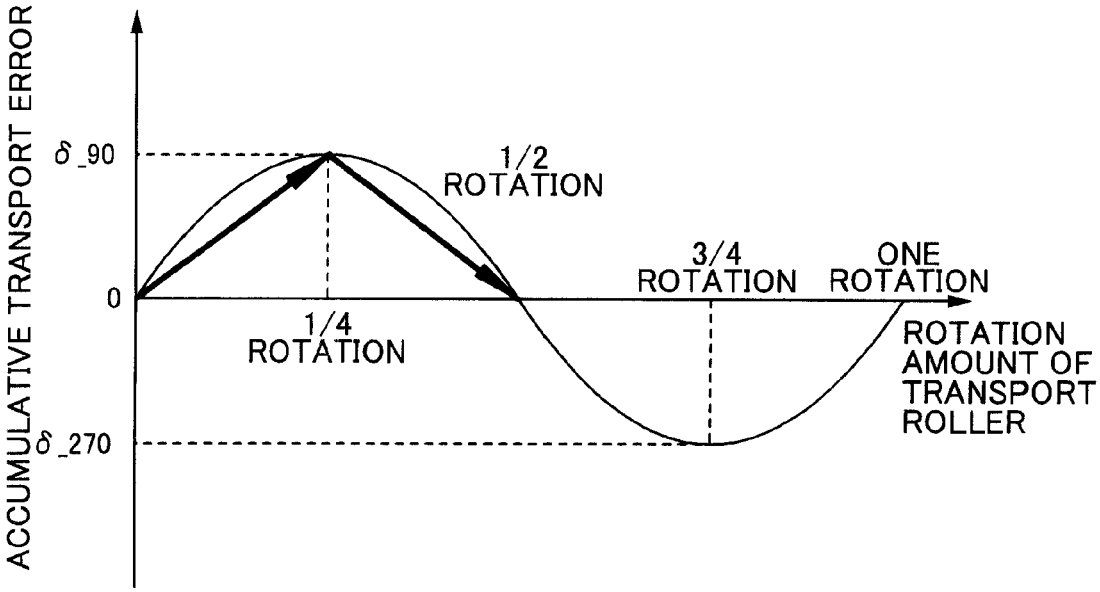
FIG. 5 is a graph for describing AC component transport error.

FIG. 5 is a graph for describing AC component transport error. The horizontal axis indicates the rotation amount of the transport roller 23 from a rotation position which is a reference. The vertical axis indicates transport error. By differentiation of the graph, the transport error that occurs when the transport roller is rotating at that rotation position is deduced. Here, accumulative transport error at the reference position is set to zero and the DC component transport error is also set to zero.

When the transport roller 23 performs a ¼ rotation from the reference position, a transport error of δ_90 occurs, and the paper is transported by ¼ inch+δ_90. However, when the transport roller 23 performs a further ¼ rotation, a transport error of −δ_90 occurs, and the paper is transported by ¼ inch −δ_90.

The following three causes are conceivable as causes of AC component transport error for example.

First, influence due to the shape of the transport roller is conceivable. For example, when the transport roller is elliptical or egg shaped, the distance to the rotational center varies in response to the location on the circumferential surface of the transport roller. And when the medium is transported at an area where the distance to the rotational center is long, the transport amount with respect to the rotation amount of the transport roller increases. On the other hand, when the medium is transported at an area where the distance to the rotational center is short, the transport amount with respect to the rotation amount of the transport roller decreases.

Secondly, the eccentricity of the rotational axis of the transport roller is conceivable. In this case too, the length to the rotational center varies in response to the location on the circumferential surface of the transport roller. For this reason, even if the rotation amount of the transport roller is the same, the transport amount varies in response to the location on the circumferential surface of the transport roller.

Thirdly, inconsistency between the rotational axis of the transport roller and the center of the scale 521 of the rotary encoder 52 is conceivable. In this case, the scale 521 rotates eccentrically. As a result, the rotation amount of the transport roller 23 with respect to the detected pulse signals varies in response to the location of the scale 521 detected by the detection section 522. For example, when the detected location of the scale 521 is far from the rotational axis of the transport roller 23, the rotation amount of the transport roller 23 with respect to the detected pulse signals becomes smaller, and therefore the transport amount becomes smaller. On the other hand, when the detected location of the scale 521 is close to the rotational axis of the transport roller 23, the rotation amount of the transport roller 23 with respect to the detected pulse signals becomes larger, and therefore the transport amount becomes larger.

As a result of these causes, the AC component transport error substantially become a sine curve as shown in FIG. 5.

Transport Error Corrected by the Present Embodiment

Figure 6:
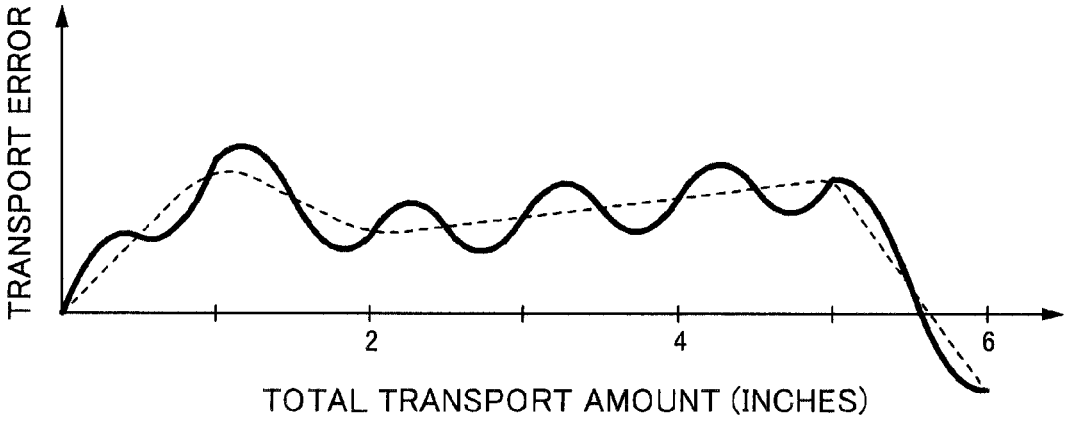
FIG. 6 is a graph (schematic diagram) of transport error that occurs when transporting a paper.

FIG. 6 is a graph (schematic diagram) of transport error that occurs when transporting a paper of a size 101.6 mm×152.4 mm (4×6 inches). The horizontal axis in the graph indicates a total transport amount of the paper. The vertical axis in the graph indicates transport error. The dotted line in FIG. 6 is a graph of the DC component transport error. The AC component transport error can be obtained by subtracting the dotted line values (DC component transport error) in FIG. 6 from the solid line values (total transport error) in FIG. 6. Regardless of the total transport amount of the paper, the AC component transport error is substantially a sine curve. On the other hand, due to the effect of paper friction and the like, the DC component transport error indicated by the dotted line is a value that varies in response to the total transport amount of the paper.

As has been described, AC component transport error varies in response to the location on the circumferential surface of the transport roller 23. For this reason, even when transporting the same sheet of paper, the AC component transport error may vary if rotation positions on the transport roller 23 at the commencement of transport vary, and therefore the total transport error (transport error indicated by a solid line on the graph) may vary. On the contrary, unlike the AC component transport error, DC component transport error has no relation to the location on the circumferential surface of the transport roller, and therefore even if the rotation positions of the transport roller 23 at the commencement of transport vary, the transport error (DC component transport error) which occurs when the transport roller 23 performs one rotation is the same.

Furthermore, when attempting to correct the AC component transport error, it is necessary for the controller 60 to detect the rotation position of the transport roller 23. However, to detect the rotation position of the transport roller 23 it is necessary to further prepare an origin sensor for the rotary encoder 52, which results in increased costs.

Consequently, in the corrections of transport amount shown below according to this embodiment, the DC component transport error is corrected.

On the other hand, the DC component transport error is a value that varies (see the dotted line in FIG. 6) in response to the total transport amount of the paper (in other words, the relative positional relationship between the paper S and the transport roller 23). For this reason, if a further greater number of correction values can be prepared corresponding to transport direction positions, fine corrections of transport error can be performed. Consequently, in this embodiment, correction values for correcting DC component transport error are prepared for each ¼ inch range rather than for each one inch range that corresponds to one rotation of the transport roller 23.

Overall Description

Figure 7:
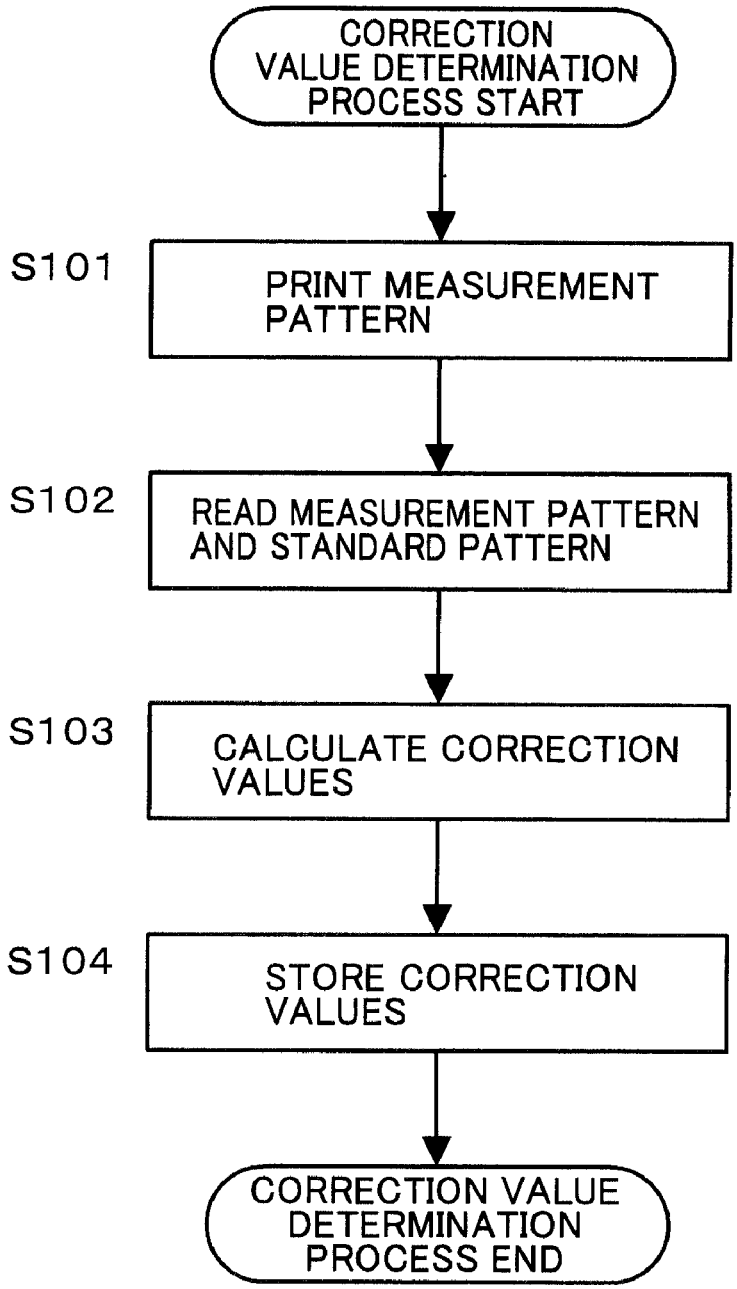
FIG. 7 is a flowchart showing up to determining the correction values for correcting transport amounts.
Figure 8A:
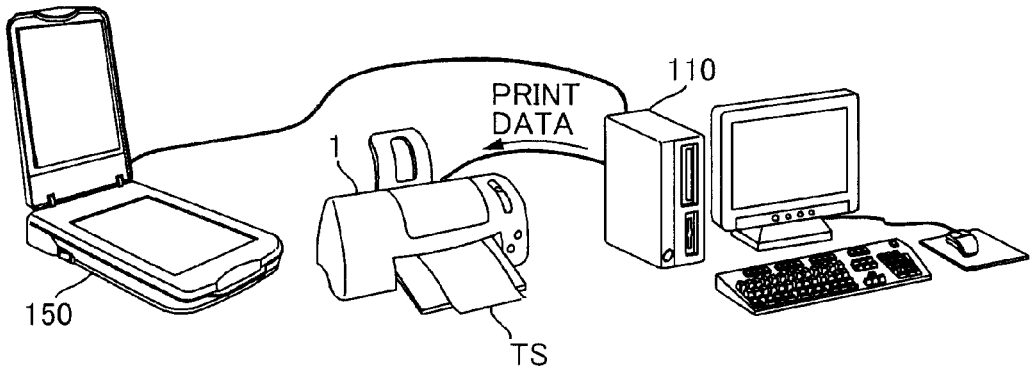
FIGS. 8A to 8C are explanatory diagrams of states before determining correction values.
Figure 8B:
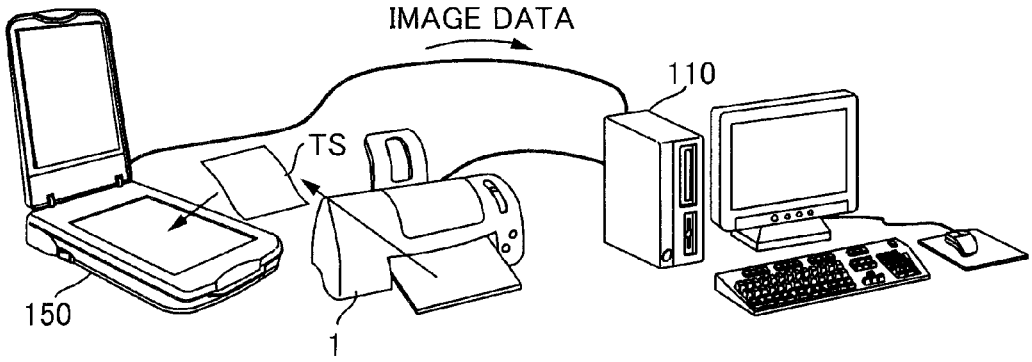
Figure 8C:
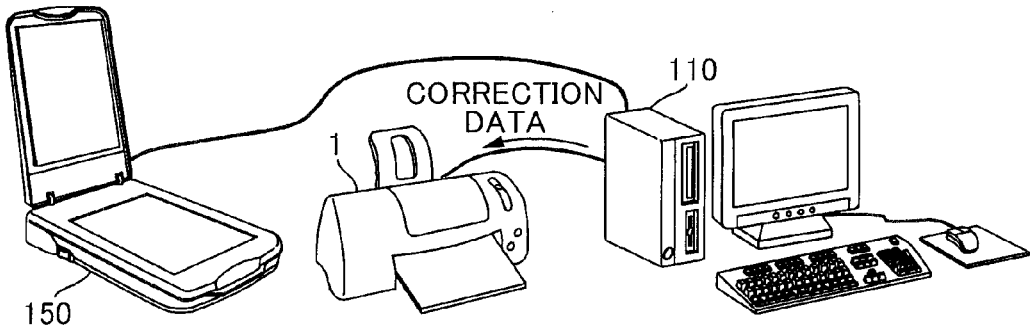

FIG. 7 is a flowchart showing up to determining the correction values for correcting transport amounts. FIGS. 8A to 8C are explanatory diagrams of conditions up to determining correction values. These processes are performed in an inspection process at a printer manufacturing factory. Prior to this process, an inspector connects a printer 1 that is assembled to a computer 110 in the factory. The computer 110 in the factory is connected to a scanner 150 as well and is preinstalled with a printer driver, a scanner driver, and a program for obtaining correction values.

First, the printer driver sends print data to the printer 1 and the printer 1 prints a measurement pattern on a test sheet TS (S101, FIG. 8A). Next, the inspector sets the test sheet TS in the scanner 150 and the scanner driver causes the measurement pattern to be read by the scanner 150 so as to obtain that image data (S102, FIG. 8B). It should be noted that a standard sheet is set in the scanner 150 along with the test sheet TS, and a standard pattern drawn on the standard sheet is also read together.

Then, the program for obtaining correction values analyzes the image data that has been obtained and calculates correction values (S103). Then the program for obtaining correction values sends the correction data to the printer 1 and the correction values are stored in a memory 63 of the printer 1 (FIG. 8C). The correction values stored in the printer reflect the transport characteristics of each individual printer.

It should be noted that the printer, which has stored correction values, is packaged and delivered to a user. When the user is to print an image with the printer, the printer transports the paper based on the correction values, and prints the image onto the paper.

Printing of a Measurement Pattern (S101)

First, description is given concerning the printing of the measurement pattern. As with ordinary printing, the printer 1 prints the measurement pattern on a paper by alternately repeating a dot forming process in which dots are formed by ejecting ink from moving nozzles and a transport operation in which the paper is transported in the transport direction. It should be noted that in the description hereinafter, the dot forming process is referred to as a "pass" and an n-th dot forming process is referred to as "pass n".

Figure 9:
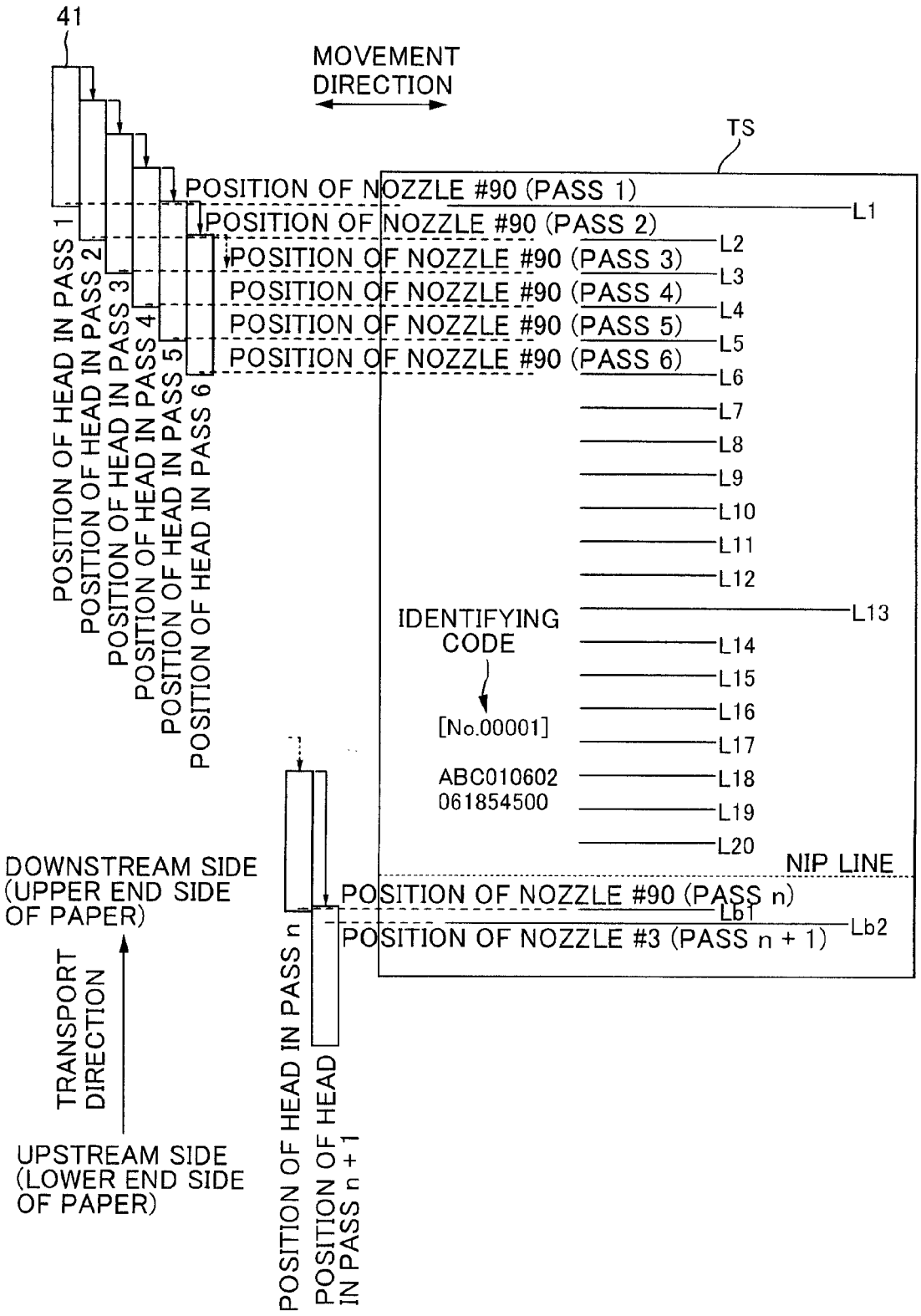
FIG. 9 is an explanatory diagram illustrating a state of printing a measurement pattern.

FIG. 9 is an explanatory diagram illustrating a state of printing a measurement pattern. The size of a test sheet TS on which the measurement pattern is printed is 101.6 mm×152.4 mm (4×6 inches).

The measurement pattern printed on the test sheet TS is shown on the right side of FIG. 9. The rectangles on the left side of FIG. 9 indicate the position (the relative position with respect to the test sheet TS) of the head 41 at each pass. To facilitate description, the head 41 is illustrated as if moving with respect to the test sheet TS, however, FIG. 9 shows the relative positional relationship of the head and the test sheet TS, and in fact the test sheet TS is being transported intermittently in the transport direction.

When the test sheet TS continues to be transported, the lower end of the test sheet TS passes through the transport roller 23. The position on the test sheet TS in opposition to the most upstream nozzle #90 when the lower end of the test sheet TS passes through the transport roller 23 is shown by a dotted line in FIG. 9 as a "NIP line". That is, in passes where the head 41 is higher than the NIP line in FIG. 9, printing is carried out in a state in which the test sheet TS is sandwiched between the transport roller 23 and the driven roller 26 (also referred to as a "NIP state"). Furthermore, in passes where the head 41 is lower than the NIP line in FIG. 9, printing is carried out in a state in which the test sheet TS is not located between the transport roller 23 and the driven roller 26 (which is a state in which the test sheet TS is transported by only the discharge roller 25 and the driven roller 27 and is also referred to as a "non NIP state").

The measurement pattern is constituted by an identifying code and a plurality of lines.

The identifying code is a symbol for individual identification for identifying each of the individual printers 1 respectively. The identifying code is also read together with the measurement pattern when the measurement pattern is read at S102, and is identified by the computer 110, using character recognition of OCR.

Each of the lines is formed along the movement direction respectively. A plurality of lines are formed on the upper end side from the NIP line. Lines on the upper end side from the NIP line are referred to "Li" in order from the upper end side for each i-th line. Furthermore, two lines are formed on the lower end side from the NIP line. Of the two lines on the lower end side from the NIP line, the upper end side line is referred to as Lb1 and the lower end side line (the lowest line) is referred to as Lb2. Particular lines are formed longer than other lines. For example, line L1, line L13, and line Lb2 are formed longer compared to the other lines. These lines are formed as follows.

First, after the test sheet TS is transported to a predetermined print commencement position, ink droplets are ejected from only nozzle #90 in pass 1 thereby forming the line L1. After pass 1, the controller 60 causes the transport roller 23 to perform a ¼ rotation so that the test sheet TS is transported by approximately ¼ inch. After transport, ink droplets are ejected from only nozzle #90 in pass 2 thereby forming the line L2. Thereafter, the same operation is repeatedly performed and the lines L1 to L20 are formed at intervals of approximately ¼ inch. In this manner, the lines L1 to L20, which are on the upper end side from the NIP line, are formed using the most upstream nozzle #90 of the nozzle #1 to nozzle #90. In this way, the most possible number of lines can be formed on the test sheet TS in the NIP state. It should be noted that although line L1 to line L20 are formed using only nozzle #90, nozzles other than the nozzle #90 are used when printing the identifying code in the pass in which the identifying code is printed.

After the lower end of the test sheet TS has passed through the transport roller 23, ink droplets are ejected from only nozzle #90 in pass n, thereby forming the line Lb1. After pass n, the controller 60 causes the transport roller 23 to perform one rotation so that the test sheet TS is transported by approximately one inch. After transport, ink droplets are ejected from only nozzle #3 in pass n+1, thereby forming the line Lb2. When assuming nozzle #1 is being used, the interval between the line Lb1 and the line Lb2 becomes extremely narrow (approximately 1/90 inch), which would make measuring difficult when the interval between the line Lb1 and the line Lb2 is to be measured subsequently. For this reason, in this embodiment, the interval between the line Lb1 and the line Lb2 is widened by forming the line Lb2 using nozzle #3, which is on the upstream side from the nozzle #1 in the transport direction, thereby facilitating measurement.

Incidentally, when transport of the test sheet TS is carried out ideally, the interval between the lines from line L1 to line L20 should be precisely ¼ inch. However, when there is transport error, the line interval is not ¼ inch. If the test sheet TS is transported by more than an ideal transport amount, then the line interval widens. Conversely, if the test sheet TS is transported by less than an ideal transport amount, then the line interval narrows. That is, the interval between certain two lines reflects the transport error in the transport process between a pass in which one of the lines is formed and a pass in which the other of the lines is formed. For this reason, by measuring the interval between two lines, it becomes possible to measure the transport error in the transport process performed between a pass in which one of the lines is formed and a pass in which the other of the lines is formed.

Similarly, the interval between the line Lb1 and the line Lb2 should be precisely 3/90 inch when transport of the test sheet TS is carried out ideally (or more accurately, when the ejection of ink from the nozzle #90 and nozzle #3 is also the same). However, when there is transport error, the line interval does not become 3/90 inch. For this reason, it is conceivable that the interval between the line Lb1 and the line Lb2 reflects transport error in the transport process in a non NIP state. For this reason, by measuring the interval between the line Lb1 and the line Lb2, it becomes possible to measure the transport error in the transport process in a non NIP state.

Pattern Reading (S102)

Scanner Configuration

First, description is given concerning the configuration of the scanner 150 used in reading the measurement pattern.

Figure 10A:
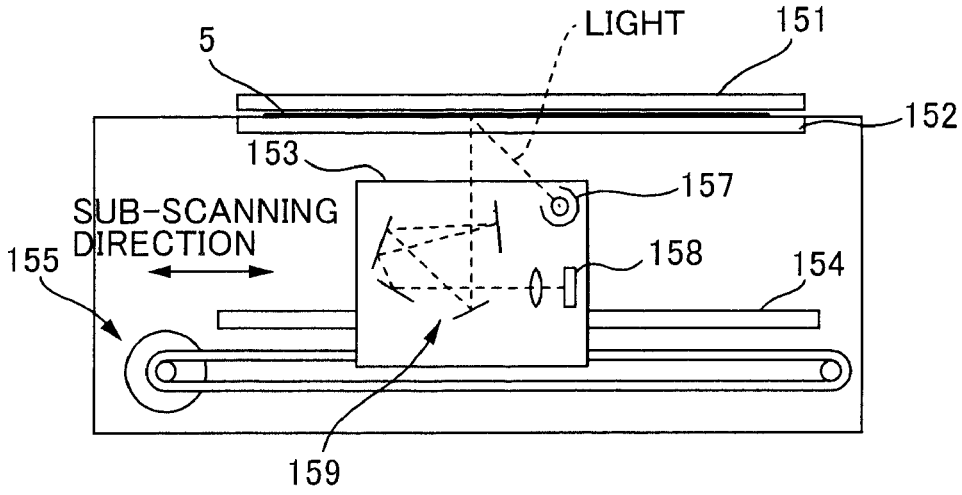
FIG. 10A is a longitudinal sectional view of the scanner 150.
Figure 10B:
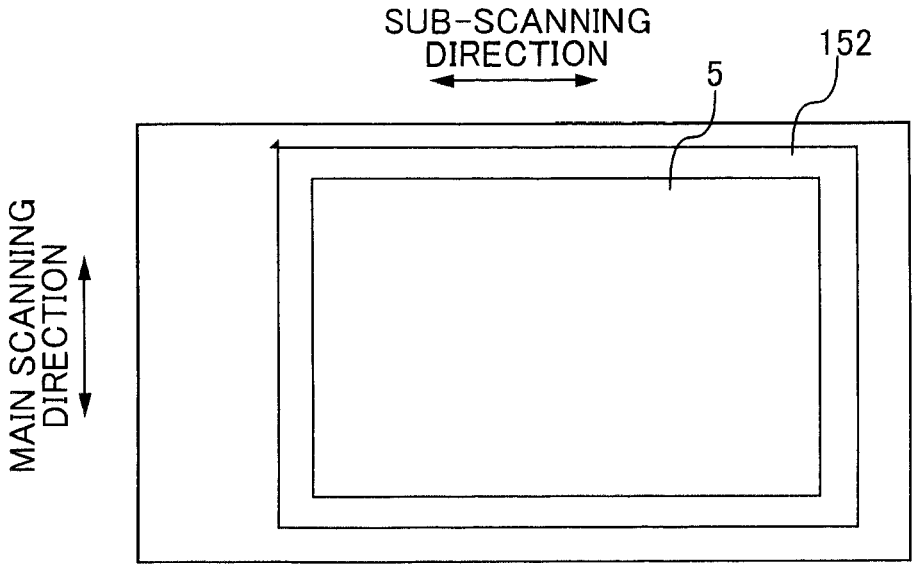
FIG. 10B is a top view of the scanner 150 with an upper cover 151 removed.

FIG. 10A is a vertical sectional view of the scanner 150. FIG. 10B is a plan view of the scanner 150 with an upper cover 151 detached.

The scanner 150 is provided with the upper cover 151, a document platen glass 152 on which a document 5 is placed, a reading carriage 153 that faces the document 5 through the document platen glass 152 and that moves in a sub-scanning direction, a guiding member 154 for guiding the reading carriage 153 in the sub-scanning direction, a moving mechanism 155 for moving the reading carriage 153, and a scanner controller (not shown) that controls each section of the scanner 150. The reading carriage 153 is provided with an exposure lamp 157 that shines light on the document 5, a line sensor 158 that detects an image of a line in the main-scanning direction (direction perpendicular to the paper surface in FIG. 10A), and an optical system 159 that lead the reflected light from the document 5 to the line sensor 158. Dashed lines in the reading carriage 153 shown in FIG. 5A show the path of light.

In order to read an image of the document 5, an operator raises the upper cover 151, places the document 5 on the document platen glass 152, and lowers the upper cover 151. The scanner controller moves the reading carriage 153 in the sub-scanning direction with the exposure lamp 157 caused to emit light, and the line sensor 158 reads the image on a surface of the document 5. The scanner controller transmits the read image data to the scanner driver of the computer 110, and thereby, the computer 110 obtains the image data of the document 5.

Positional Accuracy in Reading

As is described later, in this embodiment, the scanner 150 scans the measurement pattern of the test sheet TS and the standard pattern of the standard sheet at a resolution of 720 dpi (main scanning direction)×720 dpi (sub-scanning direction). Thus, in the following description, description is given assuming image reading at a resolution of 720×720 dpi.

Figure 11:
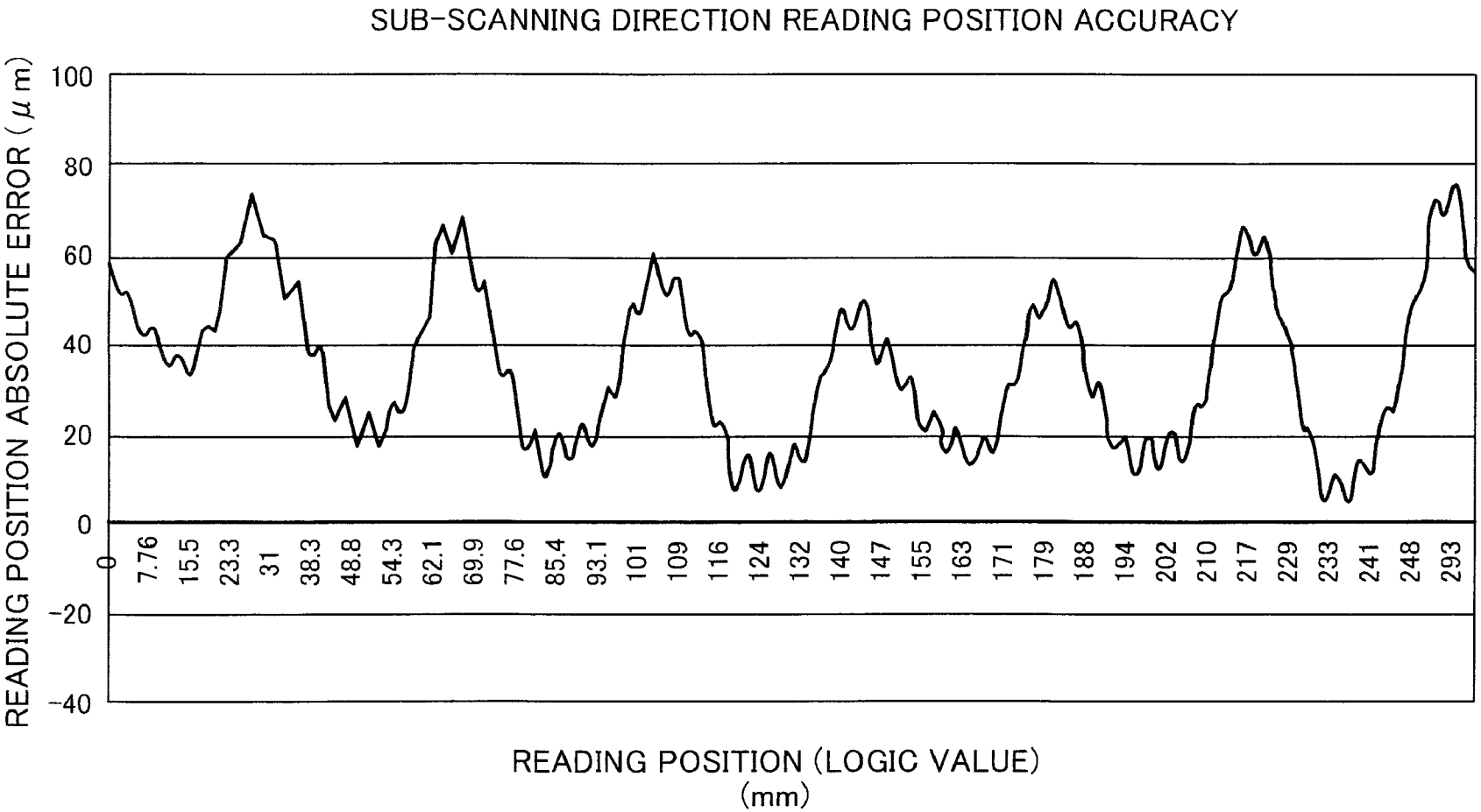
FIG. 11 is a graph of scanner reading position error.

FIG. 11 is a graph of scanner reading position error. The horizontal axis in the graph indicates reading positions (logic values) (that is, the horizontal axis in the graph indicates positions (logic values) of the reading carriage 153). The vertical axis in the graph indicates reading position error (difference between the logic values of reading positions and actual reading positions). For example, when the reading carriage 153 is caused to move 1 inch (=25.4 mm), an error of approximately 60 μm occurs.

Assuming that the logic value of the reading position and the actual reading position match, a pixel that is 720 pixels apart in the sub-scanning direction from a pixel indicating a reference position (a position where the reading position is zero) should be indicated as an image in a position precisely one inch apart from the reference position. However, when reading position error occurs as shown in the graph, the pixel that is 720 pixels apart in the sub-scanning direction from the pixel indicating a reference position is indicated as an image that is a further 60 μm apart from the position that is one inch apart from the reference position.

Furthermore, assuming that there is zero tilt in the graph, the image should be read with a uniform interval each 1/720 inch. However, when the graph tilt is in a positive position, the image is read with an interval longer than 1/720 inch. And when the graph tilt is in a negative position, the image is read with an interval shorter than 1/720 inch.

As a result, even supposing the lines of the measurement pattern are formed with uniform intervals, the line images in the image data will not have uniform intervals in a state in which there is reading position error. In this manner, in a state in which there is reading position error, line positions cannot be accurately measured by simply reading the measurement pattern.

Consequently, in this embodiment, when the test sheet TS is set and the measurement pattern is read by the scanner, a standard sheet is set and a standard pattern is also read.

Reading the Measurement Pattern and the Standard Pattern

Figure 12A:
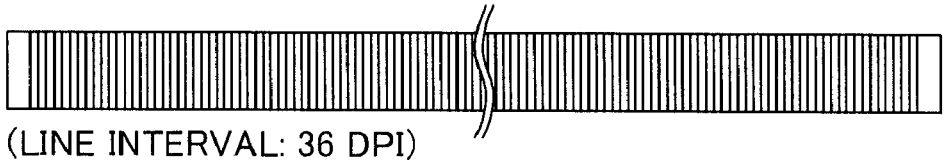
FIG. 12A is an explanatory diagram for a standard sheet SS.

FIG. 12A is an explanatory diagram for a standard sheet SS. FIG. 12 B is an explanatory diagram of a condition in which a test sheet TS and a standard sheet SS are set on the document platen glass 152.

A size of the standard sheet SS is 10 mm×300 mm such that the standard sheet SS is a long narrow shape. A multitude of lines are formed as a standard pattern at intervals of 36 dpi on the standard sheet SS. Since it is used repetitively, the standard sheet SS is constituted by a PET film rather than a paper. Furthermore, the standard pattern is formed with high precision using laser processing.

Figure 12B:
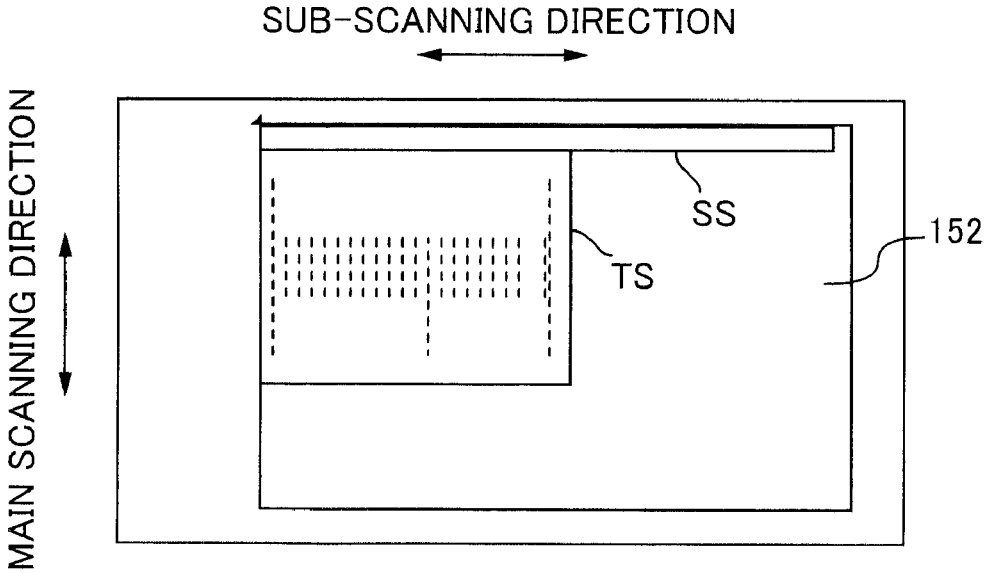
FIG. 12B is an explanatory diagram of a state in which a test sheet TS and a standard sheet SS are set on a document platen glass 152.

The test sheet TS and the standard sheet SS are set in a predetermined position on the document platen glass 152 using a jig not shown in FIG. 12B. The standard sheet SS is set on the document platen glass 152 so that its long sides become parallel to the sub-scanning direction of the scanner 150, that is, so that each line of the standard sheet SS becomes parallel to the main-scanning direction of the scanner 150. The test sheet TS is set beside this standard sheet SS. The test sheet TS is set on the document platen glass 152 so that its long sides become parallel to the sub-scanning direction of the scanner 150, that is, so that each line of the measurement pattern becomes parallel to the main-scanning direction.

In this state with the test sheet TS and the standard sheet SS being set, the scanner 150 reads the measurement pattern and the standard pattern. At this time, due to the influence of reading position error, the image of the measurement pattern in the reading result becomes a distorted image compared to the actual measurement pattern. Similarly, the image of the standard pattern also becomes a distorted image compared to the actual standard pattern.

It should be noted that the image of the measurement pattern in the reading result receives not only the influence of reading position error, but also the influence of transport error of the printer 1. On the other hand, the standard pattern is formed at a uniform interval without any relation with transport error of the printer, and therefore the image of the standard pattern receives the influence of reading position error in the scanner 150 but does not receive the influence of transport error of the printer 1.

Consequently, the program for obtaining correction values cancels the influence of reading position error in the image of the measurement pattern based on the image of the standard pattern when calculating correction values based on the image of the measurement pattern.

Calculation of Correction Values (S103)

Before describing the calculation of correction values, description is given concerning the image data obtained from the scanner 150. Image data is constituted by a plurality of pixel data. Each pixel data indicates a tone value of the corresponding pixel. When ignoring the scanner reading error, each pixel corresponds to a size of 1/720 inch×1/720 inch. An image (digital image) is constituted having pixels such as these as a smallest structural unit, and image data is data that indicates such an image.

Figure 13:
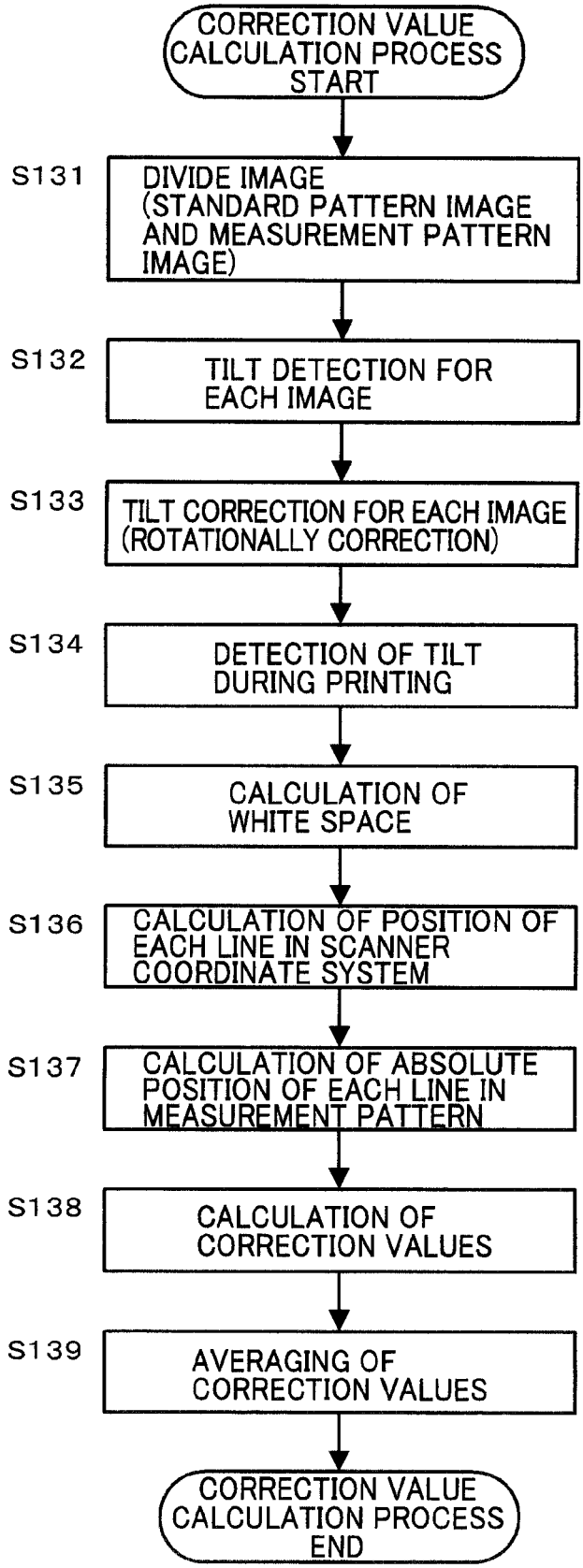
FIG. 13 is a flowchart of a correction value calculating process in S103.

FIG. 13 is a flowchart of a correction value calculating process in S103. The computer 110 executes each process in accordance with the program for obtaining correction values. That is, the program for obtaining correction values includes code for making the computer 110 perform each process.

Image Division (S131)

First, the computer 110 divides into two the image indicated by image data obtained from the scanner 150 (S131).

Figure 14:
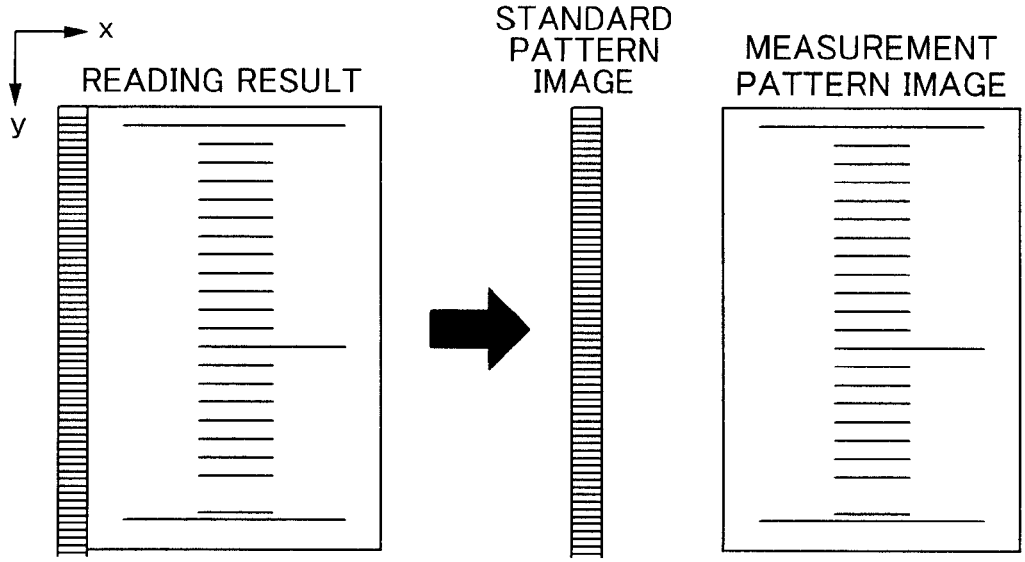
FIG. 14 is an explanatory diagram of image division (S131).

FIG. 14 is an explanatory diagram of image division (S131). On the left side of the diagram, an image indicated by image data obtained from the scanner is drawn. On the right side of the diagram, a divided image is drawn. In the following description, the lateral direction (horizontal direction) in FIG. 14 is referred to as the x direction and the vertical direction (perpendicular direction) in FIG. 14 is referred to as the y direction. Each line in the image of the standard pattern are substantially parallel to the x direction and each line in the image of the measurement pattern are also substantially parallel to the x direction.

The computer 110 divides the image into two by extracting an image of a predetermined range from the image of the reading result. By dividing the image of the reading result into two, one of the images indicates an image of the standard pattern and the other image indicates an image of the measurement pattern. A reason of dividing the image in this manner is that there is a risk that the standard sheet SS and the test sheet TS are set in the scanner 150 tilted respectively, and therefore tilt correction (S133) is performed on these separately.

Image Tilt Detection (S132)

Next, the computer 110 detects the tilt of the images (S132).

Figure 15A:
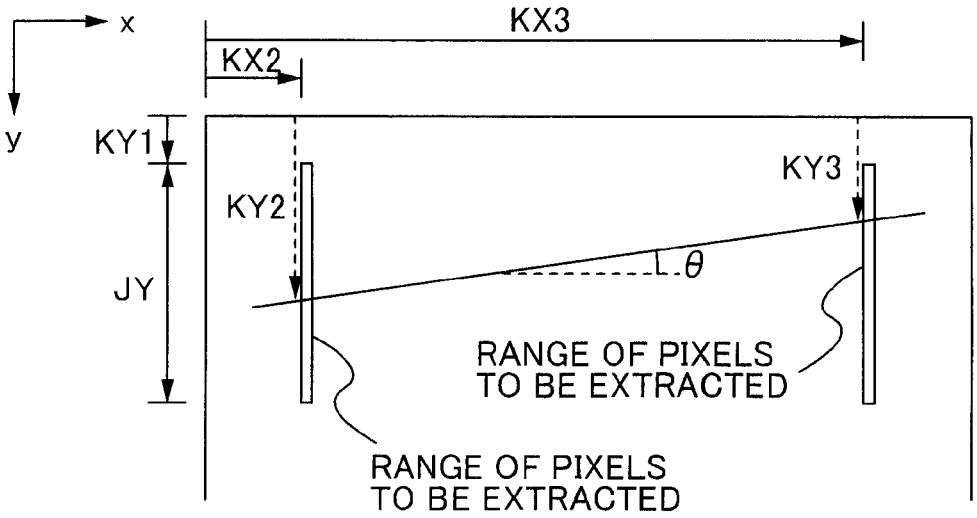
FIG. 15A is an explanatory diagram describing how a tilt of an image of the measurement pattern is detected.

FIG. 15A is an explanatory diagram of a state in which tilt of an image of the measurement pattern is detected. The computer 110 extracts a JY number of pixels from the KY1-th pixel from the top of the KX2-th pixels from the left, from the image data. Similarly, the computer 110 extracts a JY number of pixels from the KY1-th pixel from the tope of the KX3-th pixels from the left, from the image data. It should be noted that the parameters KX2, KX3, KY1, and JY are set so that pixels indicating the line L1 are contained in the pixels to be extracted.

Figure 15B:
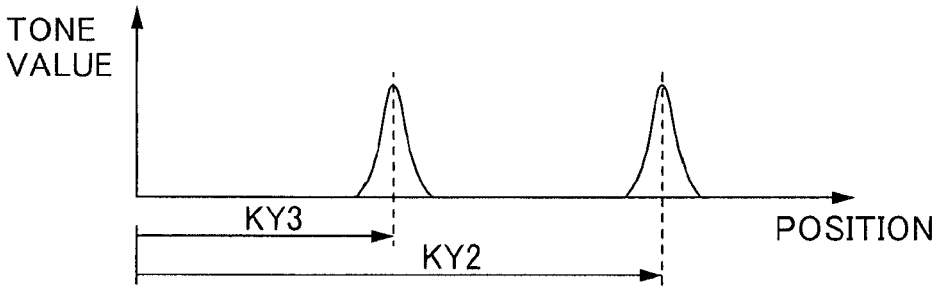
FIG. 15B is a graph of tone values of extracted pixels.

FIG. 15B is a graph of tone values of extracted pixels. The lateral axis indicates pixel positions (Y coordinates). The vertical axis indicates the tone values of the pixels. The computer 110 obtains centroid pixels KY2 and KY3 respectively based on pixel data of the JY number of pixels that have been extracted.

Then, the computer 110 calculates a tilt θ of the line L1 using the following expression:

$$\theta=\tan^{-1}\{(KY2-KY3)/(KX2-KX3)\}$$

It should be noted that the computer 110 detects not only the tilt of the image of the measurement pattern but also the tilt of the image of the standard pattern. The method for detecting the tilt of the image of the standard pattern is substantially the same as the above method, and therefore description thereof is omitted.

Image Tilt Correction (S133)

Next, the computer 110 corrects the image tilt by performing a rotation process on the image based on the tilt θ detected at S132 (S133). The image of measurement pattern is rotationally corrected based on a tilt result of the image of the measurement pattern, and the image of the standard pattern is rotationally corrected based on a tilt result of the image of the standard pattern.

A bilinear technique is used in an algorithm for processing rotation of the image. This algorithm is well known, and therefore description thereof is omitted.

Tilt Detection When Printing (S134)

Next, the computer 110 detects the tilt (skew) when printing the measurement pattern (S134). When the lower end of the test sheet passes through the transport roller while printing the measurement pattern, sometimes the lower end of the test sheet contacts the head 41 and the test sheet moves. When this occurs, the correction values that are calculated using this measurement pattern become inappropriate. Consequently, by detecting the tilt at the time of printing the measurement pattern, whether or not the lower end of the test sheet has made contact with the head 41 is detected, and if contact has been made, an error is given.

Figure 16:
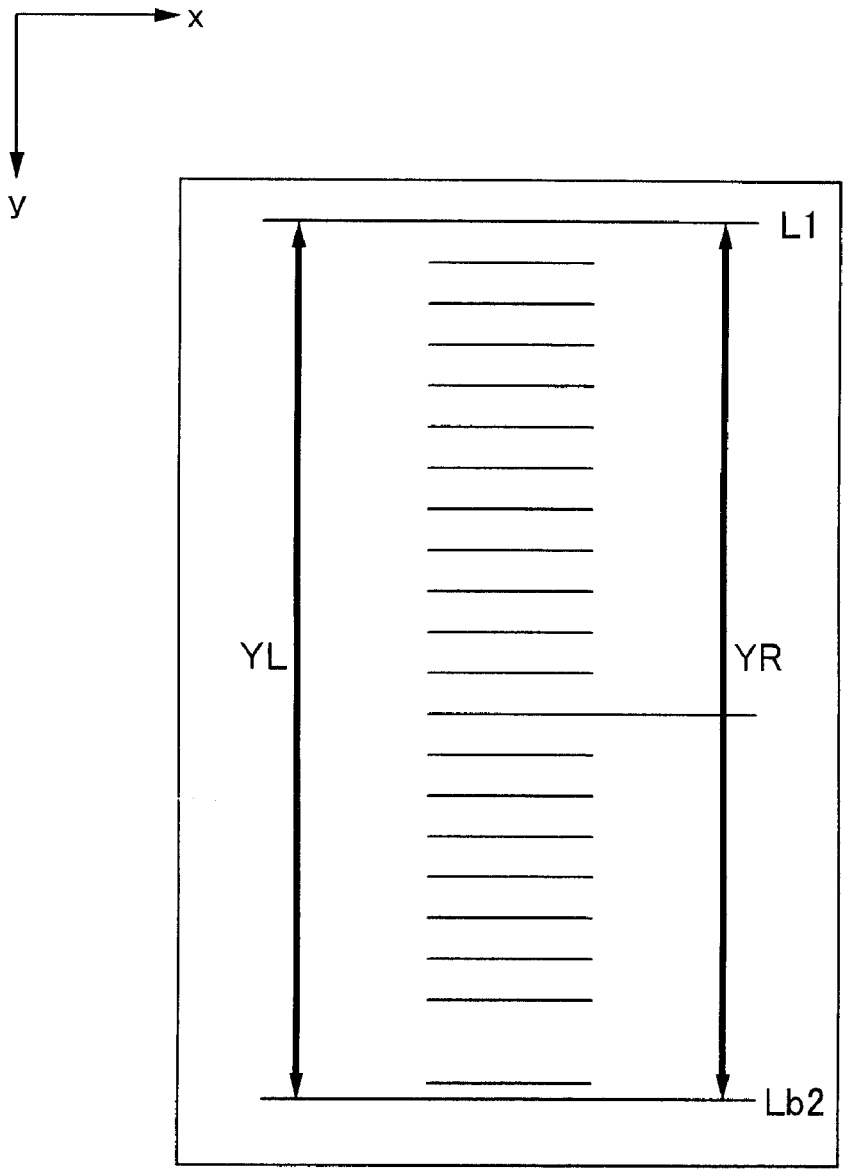
FIG. 16 is an explanatory diagram describing how a tilt of the measurement pattern at the time of printing is detected.

FIG. 16 is an explanatory diagram of a state in which tilt of the measurement pattern at the time of printing is detected. First, the computer 110 detects a left side interval YL and a right side interval YR between the line L1 (the uppermost line) and the line Lb2 (the most bottom line, which is a line formed after the lower end has passed through the transport roller). Then the computer 110 calculates a difference between the interval YL and the interval YR and proceeds to the next process (S135) if this difference is within a predetermined range, but gives an error if this difference is outside the predetermined range.

Calculating an Amount of White Space (S135)

Next, the computer 110 calculates a white space amount (S135).

Figure 17:
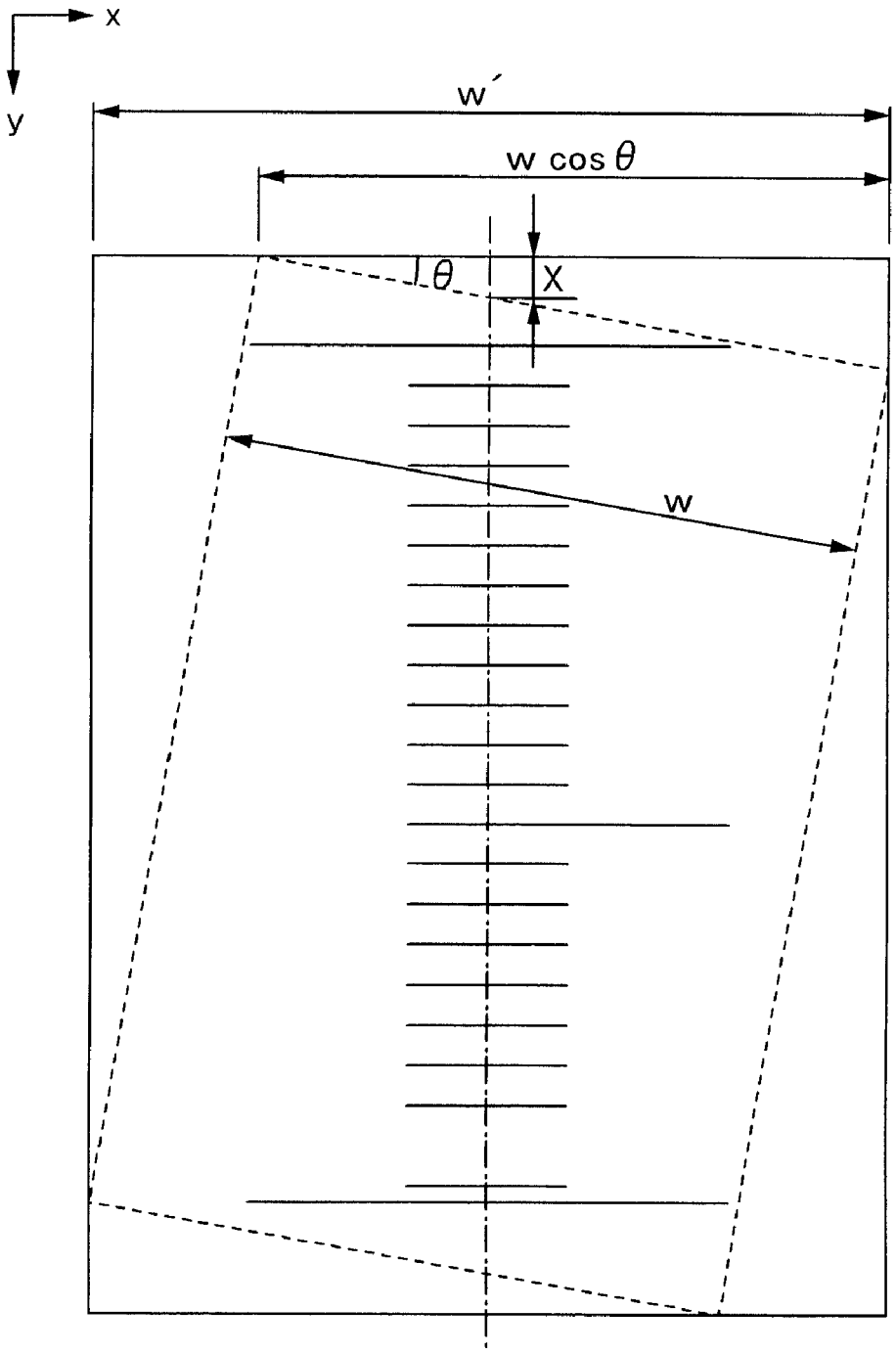
FIG. 17 is an explanatory diagram of a white space amount X.

FIG. 17 is an explanatory diagram of a white space amount X. The solid line quadrilateral (outer side quadrilateral) in FIG. 17 indicates an image after rotational correction of S133. The dotted line quadrilateral (inner side slanted quadrilateral) in FIG. 17 indicates an image prior to the rotational correction. In order to make the image after rotational correction in a rectangular shape, white spaces of right-angled triangle shapes are added to the corners of the rotated image when carrying out rotational correction processing of S133.

Supposing the tilt of the standard sheet SS and the tilt of the test sheet TS are different, the added white space amount will be different, and the positions of the lines in the measurement pattern with respect to the standard pattern will be relatively displaced before and after the rotational correction (S133). Accordingly, the computer 110 obtains the white space amount X using the following expression and prevents displacement of the positions of the lines of the measurement pattern with respect to the standard pattern by subtracting the white space amount X from the line positions calculated in S136.

$$X=(w\cos\theta-W'/2)\times\tan\theta$$

Line Position Calculations in Scanner Coordinate System (S136)

Next, the computer 110 calculates the line positions of the standard pattern and the line positions of the measurement pattern respectively in a scanner coordinate system (S136).

The scanner coordinate system refers to a coordinate system when the size of one pixel is 1/720×1/720 inches. There is reading position error in the scanner 150 and when considering reading position error, strictly speaking the actual region corresponding to each pixel data does not become 1/720 inches+1/720 inches, but in the scanner coordinate system the size of the region (pixel) corresponding to each pixel data is set to 1/720×1/720 inches. Furthermore, a position of the upper left pixel in each image is set as an origin in the scanner coordinate system.

Figure 18A:
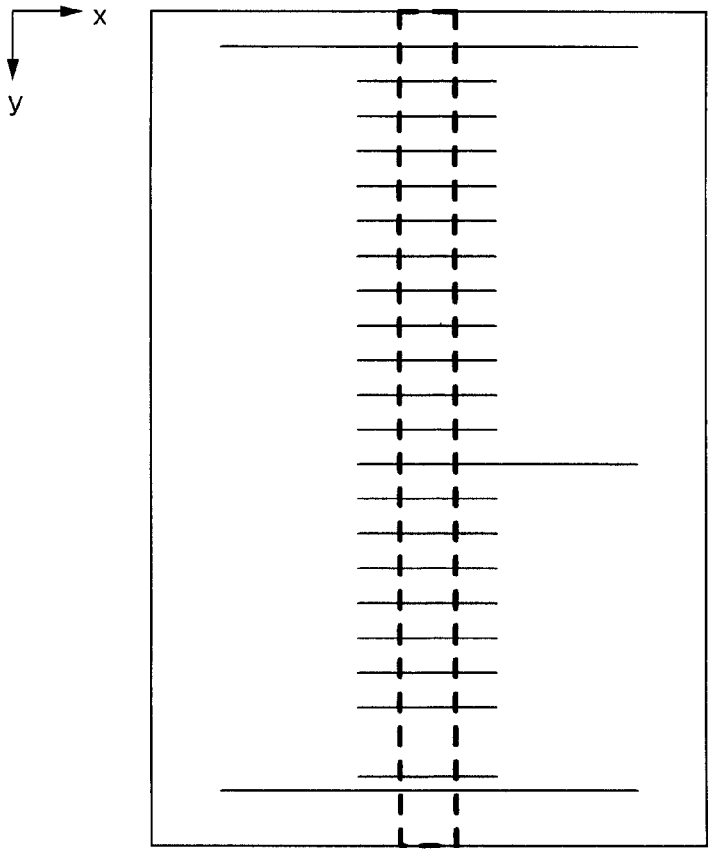
FIG. 18A is an explanatory diagram of an image range used in calculating line positions.
Figure 18B:
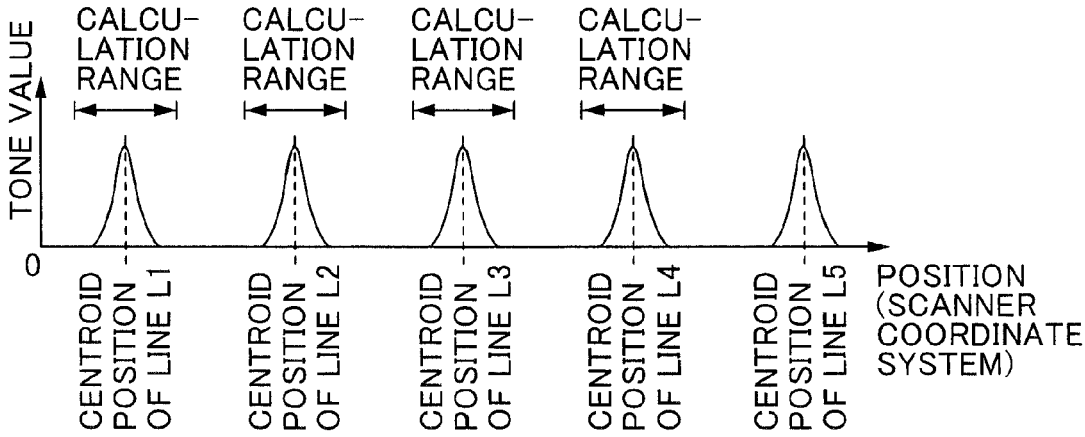
FIG. 18B is an explanatory diagram of calculating line positions.

FIG. 18A is an explanatory diagram of an image range used in calculating line positions. The image data of the image in the range indicated by the dotted line in FIG. 18A is used in calculating the line positions. FIG. 18B is an explanatory diagram of calculating line positions. The horizontal axis indicates y direction positions of pixels (scanner coordinate system). The vertical axis indicates tone values of the pixels (average values of tone values of pixels lined up in the x direction).

The computer 110 obtains a position of a peak value of the tone values and sets a predetermined calculation range centered on this position. Then, based on the pixel data of pixels in this calculation range, a centroid position of tone values is calculated, and this centroid position is set as the line position.

Figure 19:
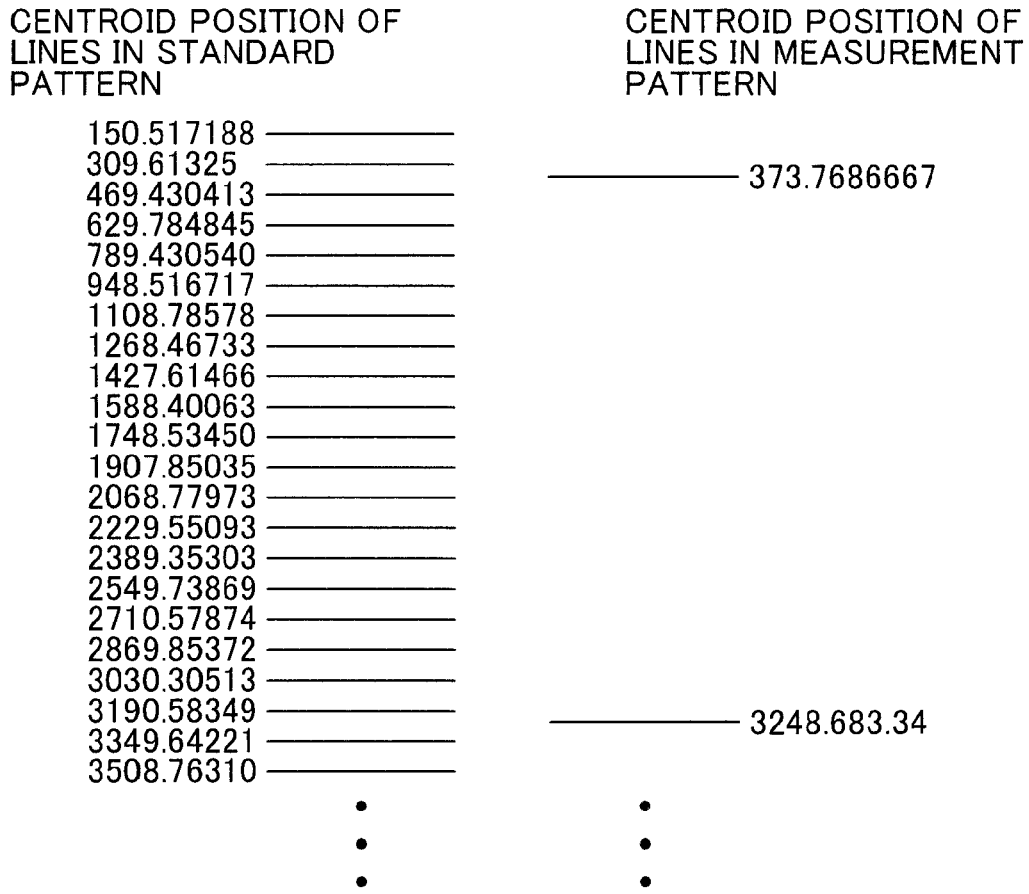
FIG. 19 is an explanatory diagram of calculated line positions.

FIG. 19 is an explanatory diagram of calculated line positions (Note that positions shown in FIG. 19 have undergone a predetermined calculation to be made dimensionless). In regard to the standard pattern, despite being constituted by lines having uniform intervals, its calculated line positions do not have uniform intervals when attention is given to the centroid positions of each line in the standard pattern. This is conceived as an influence of reading position error of the scanner 150.

Calculating Absolute Positions of Lines in Measurement Pattern (S137)

Next, the computer 110 calculates the absolute positions of lines in the measurement pattern (S137).

Figure 20:
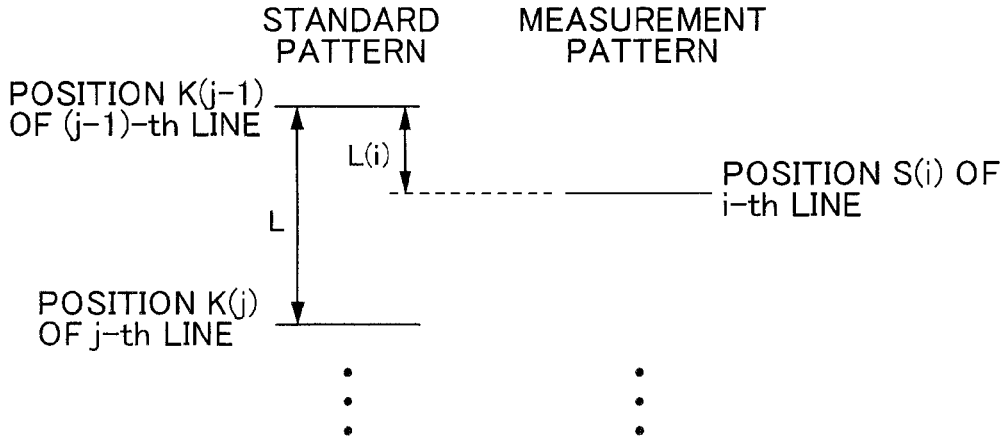
FIG. 20 is an explanatory diagram of calculating absolute positions of i-th line in the measurement pattern.

FIG. 20 is an explanatory diagram of calculating absolute positions of an i-th line in the measurement pattern. Here, the i-th line of the measurement pattern is positioned between a (j−1)-th line of the standard pattern and a j-th line of the standard pattern. In the following description, the position (scanner coordinate system) of the i-th line in the measurement pattern is referred to as "S(i)" and the position (scanner coordinate system) of the j-th line in the standard pattern is referred to as "K(j)". Furthermore, the interval (y direction interval) between the (j−1)-th line and the j-th line of the standard pattern is referred to as "L" and the interval (y direction interval) between the (j−1)-th line of the standard pattern and the i-th line of the measurement pattern is referred to as "L(i)."

First, the computer 110 calculates a ratio H of the interval L(i) with respect to the interval L based on the following expression:

$$\begin{aligned} H &= L(i)/L \\ &= \{S(i)-K(j-1)\}/\{K(j)-K(j-1)\} \end{aligned}$$

Incidentally, the standard pattern on the actual standard sheet SS are at uniform intervals, and therefore when the absolute position of the first line of the standard pattern is set to zero, the position of an arbitrary line in the standard pattern can be calculated. For example, the absolute position of the second line in the standard pattern is 1/36 inch. Accordingly, when the absolute position of the j-th line in the standard pattern is referred to as "J(j)" and the absolute position of the i-th line in the measurement pattern is referred to as "R(i)", R(i) can be calculated as shown in the following expression:

$$R(i)=\{J(j)-J(j-1)\}\times H+J(j-1)$$

Here, description is given concerning a specific procedure for calculating the absolute position of the first line of the measurement pattern in FIG. 19. First, based on the value (373.768667) of S(1), the computer 110 detects that the first line of the measurement pattern is positioned between the second line and the third line of the standard pattern. Next, the computer 110 calculates that the ratio H is 0.40143008 (=(373.7686667×309.613250)/(469.430413×309.613250)). Next, the computer 110 calculates that an absolute position R(1) of the first line of the measurement pattern is 0.98878678 mm (=0.038928613 inches={1/36 inch}×0.40143008+1/36 inch).

In this manner, the computer 110 calculates the absolute positions of lines in the measurement pattern.

Calculating Correction Values (S138)

Next, the computer 110 calculates correction values each corresponding to transport operations of multiple times carried out when the measurement pattern is formed (S138). Each of the correction values is calculated based on a difference between a logic line interval and an actual line interval.

A correction value C(i) of the transport operation carried out between the pass i and the pass i+1 is a value in which "R(i+1)−R(i)" (the actual interval between the absolute position of the line Li+1 and the line Li) is subtracted from "6.35 mm" (¼ inch, that is, the logic interval between the line Li and the line Li+1). For example, the correction value C(1) of the transport operation carried out between the pass 1 and the pass 2 is 6.35 mm−{R(2)−R(1)}. The computer 110 calculates the correction value C(1) to the correction value C(19) in this manner.

However, when calculating correction values using the lines Lb1 and Lb2, which are below the NIP line (upstream side in the transport direction), the logic interval between the line Lb1 and the line Lb2 is calculated as "0.847 mm" (=3/90 inch). The computer 110 calculates the correction value Cb of the non NIP state in this manner.

Figure 21:
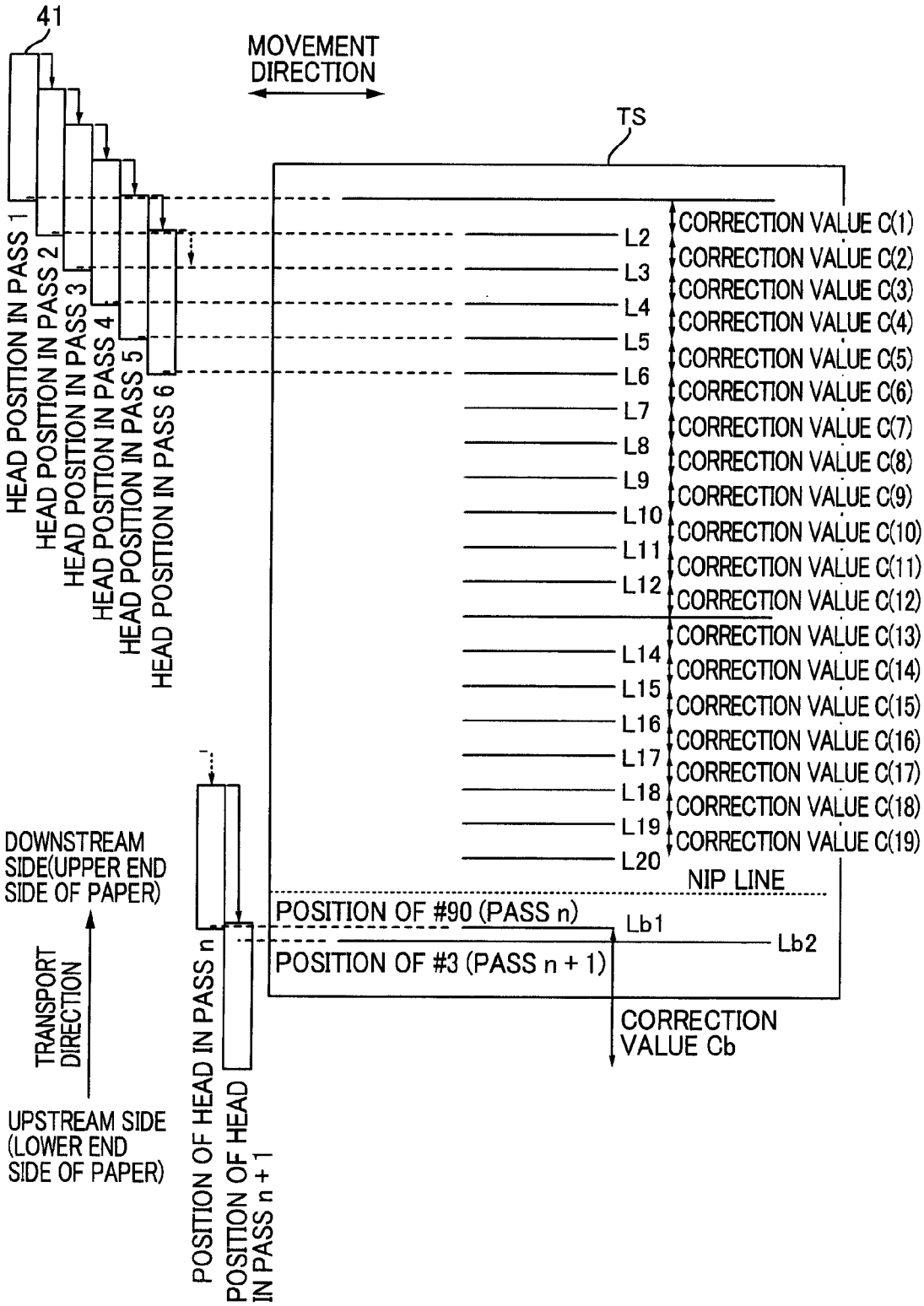
FIG. 21 is an explanatory diagram of a range corresponding to the correction values C(i).

FIG. 21 is an explanatory diagram of a range corresponding to the correction values C(i). Supposing that a value of the correction value C(1) subtracted from the initial target transport amount is set as the target in the transport operation between the pass 1 and the pass 2 when printing the measurement pattern, then the actual transport amount should become precisely ¼ inch (=6.35 mm). Similarly, supposing that a value of the correction value Cb subtracted from the initial target transport amount is set as the target in the transport operation between the pass n and the pass n+1 when printing the measurement pattern, then the actual transport amount should become precisely 1 inch.

Averaging the Correction Values (S139)

In this regard, the rotary encoder 52 of this embodiment is not provided with an origin sensor, and therefore although the controller 60 can detect the rotation amount of the transport roller 23, it does not detect the rotation position of the transport roller 23. For this reason, the printer 1 cannot guarantee the rotation position of the transport roller 23 at the commencement of transport. That is, each time printing is performed, there is a risk that the rotation position of the transport roller 23 at the commencement of transport differs. On the other hand, the interval between two adjacent lines in the measurement pattern is affected not only by the DC component transport error when transported by ¼ inch, but is also affected by the AC component transport error.

Consequently, if the correction value C that is calculated based on the interval between two adjacent lines in the measurement pattern is applied as it is when correcting the target transport amount, there is a risk that the transport amount will not be corrected properly due to the influence of AC component transport error. For example, even when carrying out a transport operation of the ¼ inch transport amount between the pass 1 and the pass 2 in the same manner as when printing the measurement pattern, if the rotation position of the transport roller 23 at the commencement of transport is different to that at the time of printing the measurement pattern, then the transport amount will not be corrected properly even though the target transport amount is corrected with the correction value C(1). If the rotation position of the transport roller 23 at the commencement of transport is 180° different compared to that at the time of printing the measurement pattern, then due to the influence of AC component transport error, not only will the transport amount not be corrected properly, but it is possible that the transport error will get worse.

Accordingly, in this embodiment, in order to correct only the DC component transport error, a correction amount Ca for correcting DC component transport error is calculated by averaging four correction values C as in the following expression:

$$Ca(i)=\{C(i-1)+C(i)+C(i+1)+C(i+2)\}/4$$

Here, description is given as a reason for being able to calculate the correction values Ca for correcting DC component transport error by the above expression.

As above mentioned, the correction value C(i) of the transport operation carried out between the pass i and the pass i+1 is a value in which "R(i+1)−R(i)" (the actual interval between the absolute position of the line Li+1 and the line Li) is subtracted from "6.35 mm" (¼ inch, that is, the logic interval between the line Li and the line Li+1). Then, the above expression for calculating the correction values Ca possesses a meaning as in the following expression:

$$Ca(i)=[25.4\text{ mm}-\{R(i+3)-R(i-1)\}]/4$$

That is, the correction value Ca(i) is a value in which a difference between an interval of two lines that should be separated by one inch in logic (the line Li+3 and the line Li−1) and one inch (the transport amount of one rotation of the transport roller 23) is divided by four. For this reason, the correction values Ca(i) are values for correcting ¼ of the transport error produced when the paper S is transported by one inch (the transport amount of one rotation of the transport roller 23). Then, the transport error produced when the paper S is transported by one inch is DC component transport error, and no AC component transport error is contained within this transport error.

Therefore, the correction values Ca(i) calculated by averaging four correction values C are not affected by AC component transport error, and are values that reflect DC component transport error.

Figures 22, 23:
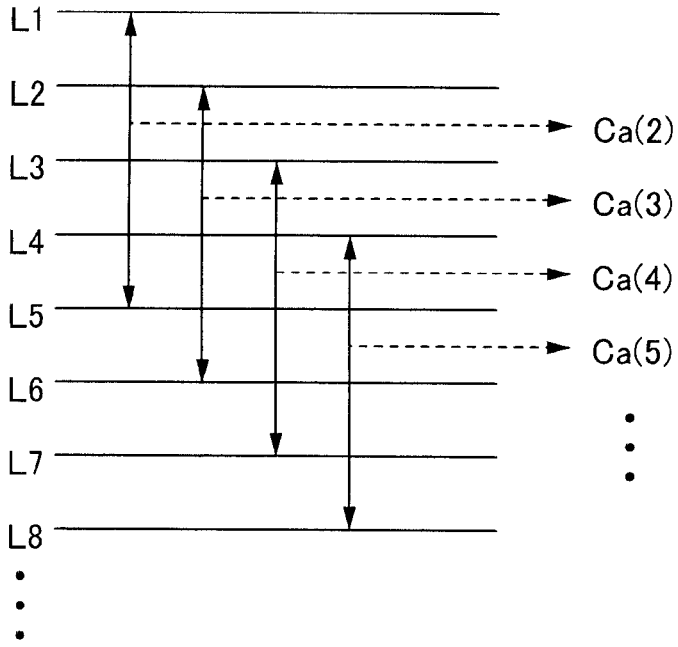
FIG. 22 is an explanatory diagram of a relationship between the lines of the measurement pattern and the correction values Ca.
FIG. 23 is an explanatory diagram of a table stored in the memory 63.

FIG. 22 is an explanatory diagram of a relationship between the lines of the measurement pattern and the correction values Ca. As shown in FIG. 22, the correction values Ca(i) are values corresponding to an interval between the line Li+3 and the line L−1. For example, the correction value Ca(2) is a value corresponding to the interval between the line L5 and the line L1. Furthermore, since the lines in the measurement pattern are formed at substantially each ¼ inch, the correction value Ca can be calculated for each ¼ inch. For this reason, the correction values Ca(i) can be set such that each correction value Ca has an application range of ¼ inch regardless of the value corresponding to the interval between two lines that should be separated by 1 inch in logic. That is, in this embodiment, the correction values for correcting DC component transport error can be set for each ¼ inch range rather than for each one inch range corresponding to one rotation of the transport roller 23. In this way, fine corrections can be performed on DC component transport error (see the dotted line in FIG. 6), which fluctuates in response to the total transport amount.

It should be noted that the correction value Ca(2) of the transport operation carried out between the pass 2 and the pass 3 is calculated at a value in which a sum total of the correction values C(1) to C(4) are divided by four (an average value of the correction values C(1) to C(4)). In other words, the correction value Ca(2) is a value corresponding to the interval between the line L1 formed in the pass 1 and the line L5 formed in the pass 5 after one inch of transport has been performed after the forming of the line L1.

Furthermore, when i−1 goes below zero in calculating the correction values Ca(i), C(1) is applied for the correction value C(i−1). For example, the correction value Ca(1) of the transport operation carried out between the pass 1 and the pass 2 is calculated as {C(1)+C(1)+C(2)+C(3)}/4. Furthermore, when i+1 goes above 20 in calculating the correction values Ca(i), C(19) is applied for C(i+1) for calculating the correction value Ca. Similarly, when i+2 goes above 20, C(19) is applied for C(i+2). For example, the correction value Ca(19) of the transport operation carried out between the pass 19 and the pass 20 is calculated as {C(18)+C(18)+C(19)+C(19)}/4.

The computer 110 calculates the correction values Ca(1) to the correction value Ca(19) in this manner. In this way, the correction values for correcting DC component transport error are obtained for each ¼ inch range.

Storing Correction Values (S104)

Next, the computer 110 stores the correction values in the memory 63 of the printer 1 (S104).

FIG. 23 is an explanatory diagram of a table stored in the memory 63. The correction values stored in the memory 63 are correction values Ca(1) to Ca(19) in the NIP state and the correction value Cb in the non NIP state. Furthermore, border position information for indicating the range in which the correction values are applied is also associated with each correction value and stored in the memory 63.

The border position information associated with the correction values Ca(i) is information that indicates a position (logic position) corresponding to the line Li+1 in the measurement pattern, and this border position information indicates a lower end side border of the range in which the correction values Ca(i) are applied. It should be noted that the upper end side border can be obtained from the border position information associated with the correction value Ca(i−1). Consequently, the applicable range of the correction value Ca(2) for example is a range between the position of the line L2 and the position of the line L3 with respect to the paper S (at which the nozzle #90 is positioned). It should be noted that the range for the non NIP state is already known, and therefore there is no need to associate border position information with the correction value Cb.

At the printer manufacturing factory, a table reflecting the individual characteristics of each individual printer is stored in the memory 63 for each printer that is manufactured. Then, the printer in which this table has been stored is packaged and shipped.

Transport Operation during Printing by Users

When printing is carried out by a user who has purchased the printer, the controller 60 reads out the table from the memory 63 and corrects the target transport amount based on the correction values, then carries out the transport operation based on the corrected target transport amount. The following is a description concerning a state of the transport operation during printing by the user.

Figure 24A:
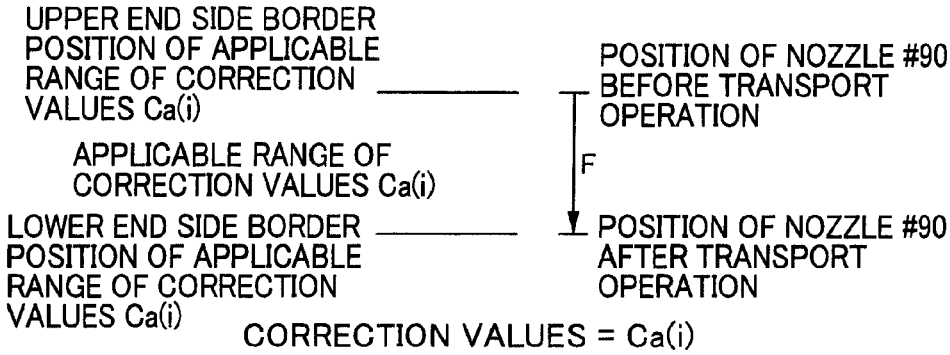
FIG. 24A is an explanatory diagram of correction values in a first case.

FIG. 24A is an explanatory diagram of correction values in a first case. In the first case, the position of the nozzle #90 before the transport operation (the relative position with respect to the paper) matches the upper end side border position of the applicable range of the correction values Ca(i), and the position of the nozzle #90 after the transport operation matches the lower end side border position of the applicable range of the correction values Ca(i). In this case, the controller 60 sets the correction values to Ca(i), sets as a target a value in which the correction value Ca(i) is added to an initial target transport amount F, then drives the transport motor 22 to transport the paper.

Figure 24B:
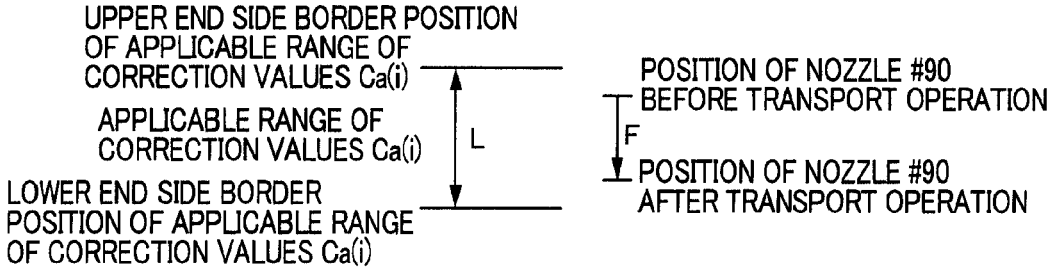
FIG. 24B is an explanatory diagram of correction values in a second case.

FIG. 24B is an explanatory diagram of correction values in a second case. In the second case, the positions of the nozzle #90 before and after the transport operation are both within the applicable range of the correction values Ca(i). In this case, the controller 60 sets as a correction value a value in which a ratio F/L between the initial target transport amount F and a transport direction length L of the applicable range is multiplied by Ca(i). Then, the controller 60 sets as a target a value in which the correction value Ca(i) multiplied by (F/L) is added to the initial target transport amount F, then drives the transport motor 22 and transports the paper.

Figure 24C:
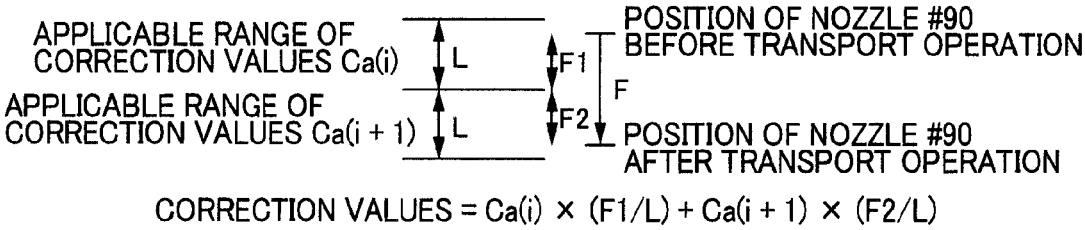
FIG. 24C is an explanatory diagram of correction values in a third case.

FIG. 24C is an explanatory diagram of correction values in a third case. In the third case, the position of the nozzle #90 before the transport operation is within the applicable range of the correction values Ca(i), and the position of the nozzle #90 after the transport operation is within the applicable range of the correction values Ca(i+1). Here, of the target transport amounts F, the transport amount in the applicable range of the correction values Ca(i) is set as F1, and the transport amount in the applicable range of the correction values Ca(i+1) is set as F2. In this case, the controller 60 sets as the correction value a sum of a value in which Ca(i) is multiplied by F1/L and a value in which Ca(i+1) is multiplied by F2/L. Then, the controller 60 sets as a target a value in which the correction value is added to the initial target transport amount F, then drives the transport motor 22 and transports the paper.

Figure 24D:
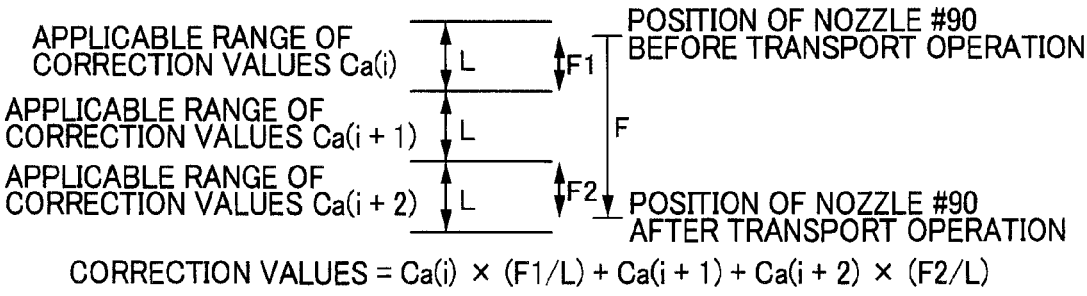
FIG. 24D is an explanatory diagram of correction values in a fourth case.

FIG. 24D is an explanatory diagram of correction values in a fourth case. In the fourth case, the paper is transported so as to pass the applicable range of the correction values Ca(i+1). In this case, the controller 60 sets as the correction value a sum of a value in which Ca(i) is multiplied by F1/L, Ca(i+1), and a value in which Ca(i+2) is multiplied by F2/L. Then, the controller 60 sets as a target a value in which the correction value is added to the initial target transport amount F, then drives the transport motor 22 and transports the paper.

In this way, when the controller corrects the initial target transport amount F and controls the transport unit based on the corrected target transport amount, the actual transport amount is corrected so as to become the initial target transport amount F, and the DC component transport error is corrected.

Incidentally, in calculating the correction values as described above, when the target transport amount F is small, the correction value will also be a small value. If the target transport amount F is small, it can be conceived that the transport error produced when carrying out the transport will also be small, and therefore by calculating the correction values in the above manner, correction values that match the transport error produced during transport can be calculated. Furthermore, an applicable range is set for each ¼ inch with respect to each of the correction values Ca, and therefore this enables the DC component transport error, which fluctuates in response to the relative positions of the paper S and the head 41 to be corrected accurately.

It should be noted that when carrying out transport in the non NIP state, the target transport amount is corrected based on the correction value Cb. When the transport amount in the non NIP state is F, the controller 60 sets as a correction value a value in which the correction value Cb is multiplied by F/L. However, in this case, L is set as one inch regardless of the range of the non NIP state. Then, the controller 60 sets as a target a value in which the correction value (Cb×F/L) is added to the initial target transport amount F, then drives the transport motor 22 and transports the paper.

Other Embodiments

In the above-described embodiment, a head was provided in the carriage, and the head was configured to be movable in the movement direction. And in the foregoing embodiment, dot lines (raster lines) are formed on the paper in the movement direction as a result of the head intermittently ejecting ink while moving in the movement direction. However, the configuration of the head is not limited to this configuration. Furthermore, there is also no limitation to a dot line forming method. Hereinafter, another embodiment is described.

Regarding the Configuration

Figure 25A:
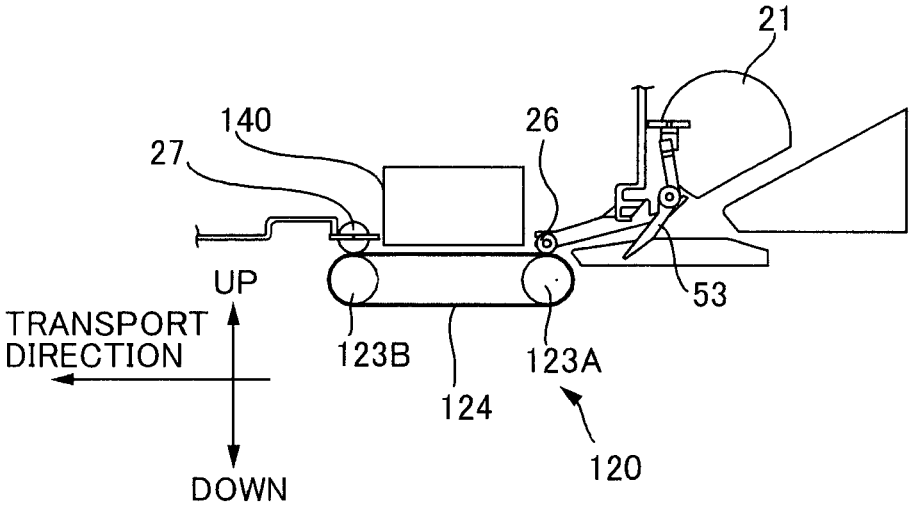
FIG. 25A is a cross sectional view of a printer according to a different embodiment.
Figure 25B:
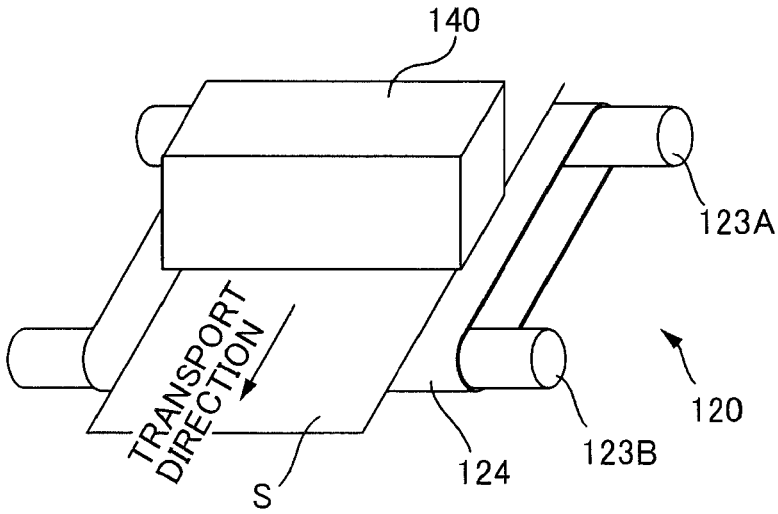
FIG. 25B is a perspective view for illustrating a transporting process and a dot forming process of the printer according to the different embodiment.

FIG. 25A is a cross sectional view of a printer according to a different embodiment. FIG. 25B is a perspective view for illustrating a transporting process and a dot forming process of the printer according to the different embodiment. Further description of structural elements that are the same as the foregoing embodiments is omitted.

A transport unit 120 is for transporting a medium (for example, such as paper S) in a predetermined direction (hereinafter referred to as a "transport direction"). The transport unit 120 has an upstream-side transport roller 123A, a downstream-side transport roller 123B, and a belt 124. When the transport motor (not shown) rotates, the upstream-side transport roller 123A and the downstream-side transport roller 123B rotate, and the belt 124 rotates. The paper S that has been supplied by the paper feed roller 21 is transported by the belt 124 up to a printable area (area opposed to the head). When the belt 124 transports the paper S, the paper S moves in the transport direction with respect to the head unit 140. The paper S that has passed through the printable area is discharged to the outside by the belt 124. It should be noted that the paper S that is being transported is electrostatically-clamped or vacuum-clamped to the belt 124.

The head unit 140 is for ejecting ink onto the paper S. By ejecting ink onto the paper S that is being transported, the head unit 140 forms dots on the paper S, so that an image is printed on the paper S.

Figure 26:
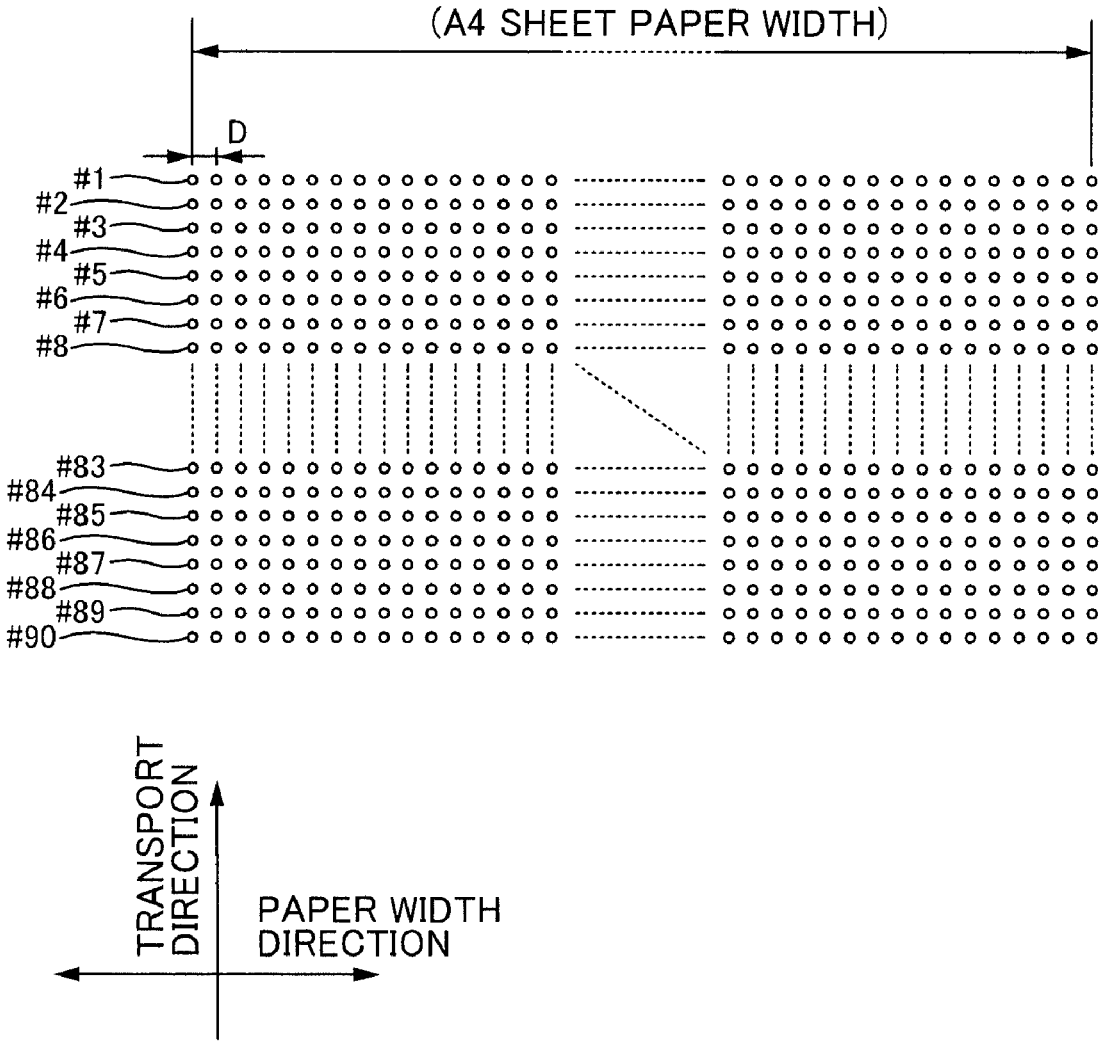
FIG. 26 is an explanatory diagram of an arrangement of nozzles on a lower face of the head of the different embodiment.

FIG. 26 is an explanatory diagram of an arrangement of nozzles on a lower face of the head of this embodiment. Here, in order to simplify description, description is given concerning a monochrome printer (a printer that ejects only black ink).

In this embodiment, nozzle rows are configured by lining up 90 nozzles from nozzle #1 to nozzle #90 in the transport direction. Further still, in this embodiment, a multitude of nozzle rows constituted by the 90 nozzles are lined up corresponding to an A4 size paper width in the paper width direction (which corresponds to the movement direction in the above-described embodiment). That is, a multitude of nozzles are lined up in a matrix form along the transport direction and the paper width direction.

The nozzle pitch in the transport direction is the same as the nozzle pitch in the above-described embodiment. The nozzle pitch in the paper width direction is designed so as to be the same as the dot interval between dots constituting the raster lines in the above-described embodiment. For this reason, by ejecting ink simultaneously from the nozzles in the head of this embodiment, it becomes possible to form dots in a range in which ink can be ejected by the head during movement in the above-described embodiment.

Regarding Determining the Correction Values

The processes up to determining the correction values for correcting the transport amount are substantially the same as the above-described embodiment (see FIG. 7). Here, description is given concerning the printing of the measurement pattern in this embodiment. As with ordinary printing or printing the measurement pattern as in the above-described embodiment, the printer carries out printing by alternately repeating a dot forming process in which dots are formed by ejecting ink from the nozzles and a transport process in which the paper is transported in the transport direction.

However, there is a difference from the above-described embodiment in regard to the dot forming process. In the above-described embodiment, each line was formed by intermittently ejecting ink while a single nozzle moves. On the other hand, in this embodiment, each line is formed by simultaneously ejecting ink from a plurality of nozzles lined up in the paper width direction.

First, after the test sheet TS is transported to a predetermined print commencement position, ink droplets are simultaneously ejected from the plurality of nozzles #90 lined up in the paper width direction in pass 1, thereby forming a line L1. After pass 1, the controller 60 causes the upstream-side transport roller 123A to perform a ¼ rotation so that the test sheet TS is transported by approximately ¼ inch. After transport, ink droplets are simultaneously ejected from the plurality of nozzles #90 in pass 2, thereby forming the line L2. Thereafter, the same operation is repeated and the lines L1 to L20 are formed at intervals of approximately ¼ inch. In this manner, the line L1 to line L20, which are on the upper end side from the NIP line, are formed using the most upstream nozzle #90 of the nozzles #1 to nozzle #90. In this way, the most possible number of lines can be formed on the test sheet TS in the NIP state. It should be noted that although line L1 to line L20 are formed using only nozzle #90, nozzles other than the nozzle #90 are used when printing the identifying code in the passes in which the identifying code is printed.

After the lower end of the test sheet TS has passed through between the transport roller 123A and the driven roller 26, ink droplets are simultaneously ejected from the plurality of nozzles #90 lined up in the paper width direction in pass n, thereby forming the line Lb1. After pass n, the controller 60 causes the upstream-side transport roller 123A to perform one rotation so that the test sheet TS is transported by approximately 1 inch. After transport, ink droplets are simultaneously ejected in pass n+1 from the plurality of nozzles #3 lined up in the paper width direction, thereby forming the line Lb2. When assuming nozzle #1 is being used, the interval between the line Lb1 and the line Lb2 becomes extremely narrow (approximately 1/90 inch), which would make measuring difficult when the interval between the line Lb1 and the line Lb2 is to be measured subsequently. For this reason, the interval between the line Lb1 and the line Lb2 is widened by forming the line Lb2 using nozzle #3, which is on the upstream side from the nozzle #1 in the transport direction, thereby facilitating measurement.

By printing each line with the printer as described above, a measurement pattern equivalent to that of FIG. 9 in the above-described embodiment can be printed. Processes after the measurement pattern has been printed (the pattern reading process, correction value calculation process, and the correction value storing process) are the same as in the above-described embodiment, and therefore description is omitted.

It should be noted that in this embodiment also, the printer side controller prints the line L1 on the test sheet, then prints the line L2 after the test sheet has been transported by ¼ inch by causing the upstream-side transport roller 123A to rotate by a rotation amount of less than one rotation from a rotation position of the transport roller at the time of printing the line L1, then prints the line L5 after the test sheet has been transported by one inch by causing the upstream-side transport roller 123A to rotate by a rotation amount of one rotation from the rotation position of the transport roller at the time of printing the line L1, and then prints the line L6 after the test sheet has been transported by one inch by causing the upstream-side transport roller 123A to rotate by a rotation amount of one rotation from the rotation position of the transport roller at the time of printing the line L2. Then, the correction value Ca(2) is calculated based on the interval between the line L1 and the line L5, and the correction value Ca(3) is calculated based on the interval between the line L2 and the line L6.

Also, in this embodiment too, a plurality of correction values associated with the relative positions between the head and the paper S (more specifically, the relative position between the nozzle #90 and the paper S) are stored in the memory 63.

Concerning Transport operation during Printing by Users

When printing is to be carried out by a user who has purchased the printer, the printer carries out printing by alternately repeating a dot forming process in which dots are formed by ejecting ink from the nozzles and a transport process in which the paper is transported in the transport direction. However, in this embodiment, by ejecting ink simultaneously from the nozzles in the head between each transport process, it becomes possible to form dots in a range in which ink can be ejected by the head during movement in the above-described embodiment.

In the printer of this embodiment also, the controller 60 reads out the table from the memory 63 and corrects the target transport amount based on the correction values, then carries out the transport operation based on the corrected target transport amount. This aspect is the same as in the above-described embodiment, and therefore description thereof is omitted.

It should be noted that in this embodiment also, the applicable range of the correction value Ca(2) is a range in which the nozzles #90 are positioned between the position of the line L2 and the position of the line L3 with respect to the paper S. That is, the application range of the correction value Ca(2) is while the positional relationship between the paper S and the transport roller 123A corresponds to a positional relationship between a positional relationship between the test sheet TS and the transport roller 123A during printing of the line L2, and a positional relationship between the test sheet TS and the transport roller 123A during printing of the line L3. Furthermore, the applicable range of the correction value Ca(3) is a range in which the nozzles #90 are positioned between the position of the line L3 and the position of the line L4 with respect to the paper S. That is, the application range of the correction value Ca(3) is while the positional relationship between the paper S and the transport roller 123A corresponds to a positional relationship between a positional relationship between the test sheet TS and the transport roller 123A during printing of the line L3 and a positional relationship between the test sheet TS and the transport roller 123A during printing of the line L4. That is, the applicable range of the correction value Ca(3) is a range which is obtained by rotating the transport roller 123A by a rotation amount of ¼ rotation from the end of the applicable range of the correction value Ca(2).

Furthermore, in this embodiment, as shown in FIG. 24A to FIG. 24D of the above-described embodiment, the controller 60 corrects the target transport amount based on the number of correction values corresponding to a size of the target transport amount including correction values corresponding to the relative positions of the nozzles #90 before transport. For example, when the target transport amount is small as shown in FIG. 24B, the controller 60 corrects the target transport amount based on the correction values Ca(i) corresponding to the relative positions of the nozzles #90 before transport. And, for example, when the target transport amount includes applicable ranges of the plurality of correction values as shown in FIG. 24D, the controller 60 corrects the target transport amount based on three correction values (Ca(i), Ca(i+1), Ca(i+2)) including the correction values Ca(i) corresponding to the relative positions of the nozzles #90 before transport.

The same effects as those in the previously described embodiments can also be achieved in the above-described embodiment.

Other Embodiments

In the foregoing embodiment a printer was mainly described, however, it goes without saying that the foregoing embodiment also includes the disclosure of printing apparatuses, recording apparatuses, liquid ejection apparatuses, transport methods, printing methods, recording methods, liquid ejection methods, printing systems, recording systems, computer systems, programs, storage media storing programs, display screens, screen display methods, methods for producing printed material and the like.

Also, a printer, for example, serving as an embodiment was described above. However, the foregoing embodiment is for the purpose of elucidating the present invention and is not to be interpreted as limiting the present invention. The invention can of course be altered and improved without departing from the gist thereof and includes functional equivalents. In particular, embodiments described below are also included in the present invention.

Regarding Correction Values to be stored in the Memory

In the above described embodiment, the table shown in FIG. 23 is stored in the memory 63. Then, when printing is performed by the user, the table is read from the memory 63, and correction values with respect to the target transport amount are calculated as shown in FIGS. 24A to 24D, and the target transport amount is corrected. However, it is not limited to such an embodiment.

For example, the target transport amount of each of the plurality of times of transport operations when printing is performed is determined in advance, so that with respect to each of the target transport amounts, correction values with respect to the target transport amount can be calculated in advance as shown in FIGS. 24A to 24D, and the correction values calculated as in FIGS. 24A to 24D can be associated with each of the target transport amounts and stored in the memory 63. In this way, when printing is performed by the user, the target transport amount can be corrected, without calculating the correction values with respect to the target transport amounts shown in FIGS. 24A to 24D, but by merely reading the correction values corresponding to the target transport amount from the memory.

Regarding Correction

Normally a print mode is selected according to paper type (normal paper/glossy paper) or print image quality (print resolution). Then, depending on the print mode, there are some that have no preference of image quality. For example, if the paper type is normal paper, a print mode that does not have a good image quality compared to the case of glossy paper is selected (instead a print mode that has a fast print speed is selected). Further, when the user places priority on print speed more than on print image quality, a print mode that does not have good image quality is selected. Thus, in a case where a print mode with an image quality that is not good is selected, even if the correction of the target transport amount as in the above described embodiment is performed, it is considered that the image quality will not improve much.

Thus, according to the selected print mode, the controller 60 can change whether or not to perform correction of the target transport amount in the above described embodiment. For example, in the print mode selected when printing a glossy paper, or in the print mode selected when printing at a high print resolution, the correction of the target transport amount as in the above described embodiment is performed. On the other hand, in the print mode selected when printing a normal paper, and the print mode selected when printing at a low print resolution, the correction of the target transport amount as in the above described embodiment is not performed. Note that, when the correction of the target transport amount as in the above described embodiment is not performed, the controller 60 can perform a transport operation by correcting the target transport amount with a certain correction value, or can perform a transport operation without correcting the target transport amount.

Regarding the Printer

In the above-described embodiments a printer was described, however, there is no limitation to this. For example, technology similar to that of the present embodiments can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices.

Furthermore, there is no limitation to the use of piezo elements and, for example, application in thermal printers or the like is also possible. Furthermore, there is no limitation to ejecting liquids and application in wire dot printers or the like is also possible.

Overview (1) The printer in the above described embodiment includes the head 41, the transport unit 20, the memory 63, and the controller 60. The transport unit 20 transports the paper S in the transport direction with respect to the head 41, according to the target transport amount.

By the way, the controller controls the transport unit 20 based on the target transport amount, but when there is a transport error, the target transport amount and the actual transport amount do not match. Then, the controller 60 controls the transport unit based on the corrected target transport amount after correcting the target transport amount, so that the transport error is corrected so as to match the target transport amount and the actual transport amount.

Here, a DC component transport error is a value that differs according to a total transport amount of paper (see dotted line in FIG. 6), due to the influence of friction of paper and the like. In other words, the transport error of a DC component becomes a different value according to a relative positional relationship between the paper S and the head 41.

Thus, in the memory 63 of this embodiment, there are stored a plurality of correction values (refer to FIG. 23) associated with a relative position of the head and the paper S (more specifically, a relative position between the nozzle #90 and the paper S). Then, as shown in FIGS. 24A to 24D, in this embodiment, the controller 60 corrects the target transport amount, based on correction values of a number according to a size of the target transport amount including a correction value according to a relative position of the nozzle #90 before transport. For example, when the target transport amount is small as shown in FIG. 24B, the controller 60 corrects the target transport amount, based on a correction value Ca(i) according to a relative position of the nozzle #90 before transport. Further, for example, in a case where the target transport amount is a size that exceeds an application range of a plurality of correction values as shown in FIG. 24D, the controller 60 corrects the target transport amount, based on three correction values (Ca(i), Ca(i+1), Ca(i+2)), including the correction value C(i), according to a relative position of the nozzle #90 before transport.

In this way, the DC component transport error that changes according to a relative position of the paper S and the head 41 can be accurately corrected according to the transport amount.

(2) Each correction value is associated with a range of a relative position to be applied the correction value. For example, with the above described correction value Ca(i), a range is associated so that a position corresponding to a line Li of a measurement pattern (a theoretical position) is a boundary position on an upper end side of the application range, and a position that corresponds to a line Li+1 of a measurement pattern (a theoretical position) is a boundary position on a lower end side of the application range.

Then, in the case where transport is performed exceeding an application range of the correction value corresponding to a relative position before transport, the controller 60 corrects the target transport amount, based on the correction value corresponding to a relative position before transport and a correction value corresponding to a relative position after transport. For example, as shown in FIG. 24C, in a case where transport is performed exceeding the application range of the correction value Ca(i) corresponding to a relative position before transport, the controller corrects the target transport amount, based on the correction value Ca(i) corresponding to a relative position before correction and the correction value Ca(i+1) corresponding to a relative position after correction.

In this way, the DC component transport error that changes according to a relative position of the paper S and the head 41 can be accurately corrected according to the transport amount.

(3) The above described controller 60 assigns weights to correction values according to a ratio of a range of the relative position which changes during transport to an application range of the correction value, and corrects the target transport amount. For example, in the case as shown in FIG. 24B, the controller 60 assigns weights to the correction value Ca(i) according to a ratio F/L of a range F that changes of a relative position during transport and an application range L of the correction value, and corrects the target transport amount. Further, for example, in the case as shown in FIG. 24C, the controller 60 assigns weights to the correction value Ca(i) according to a ratio F1/L of a range F1 that changes of a relative position during transport to an application range L of the correction value, and assigns weights to the correction value Ca(i+1) according to a ratio F2/L of a range F2 that changes of a relative position during transport and an application range L of the correction value, and corrects the target transport amount.

In this way, the transport error of a DC component that changes according to a relative position of the paper S and the head 41 can be corrected accurately according to the transport amount.

(4) In the above described embodiment, by averaging four correction values C, a correction amount Ca for correcting a DC component transport error is calculated (S139 in FIG. 13). This correction value Ca is a value according to a distance between a certain line and a line that has been formed after the paper has been transported 1 inch since the previous line has been formed. Therefore, each correction value Ca is a correction value for correcting the transport error (DC component transport error) when transporting the paper S by making the transport roller rotate once.

In the above described embodiment, each correction value Ca is obtained for every ¼ inch range. In other words, the application range of each correction value Ca corresponds to a transport amount when transporting the paper S by making the transport roller 23 rotate by a ¼ rotation. Thus, according to the above described embodiment, fine correction can be performed on the DC component transport error. If the application range of the correction value Ca becomes 1 inch, it is not possible to perform fine correction to the DC component transport error (see dotted line in FIG. 6) that changes according to the total transport amount of paper.

(5) In the above described embodiment, before the correction value Ca is stored in the memory 63, the controller 60 prints a measurement pattern. In this measurement pattern, there are included, for example, a line L1 (an example of a first pattern), a line L2 (an example of a second pattern), a line L5 (an example of a third pattern), and a line L6 (a fourth pattern). In this way, the measurement pattern for obtaining a correction value for correcting the DC component transport error is formed with a plurality of lines with an interval smaller than 1 inch (1 rotation of the transport roller 23).

Then, the memory 63 is stored with a correction value Ca(2) determined based on the line L1 and the line L5 and a correction value Ca(3) determined based on the line L2 and the line L6. Then, the controller 60 corrects the target transport amount based on the correction value Ca(2) in a certain application range and transports the paper S, and corrects the target transport amount based on the correction value Ca(3) in an application range that is ¼ inch apart from the application range of the correction value Ca(2) and transport the paper S.

In such an embodiment described above, more correction values can be obtained, and the transport error of a DC component can be finely corrected. Supposing that the lines of the measurement pattern are formed with a 1 inch interval, the number of correction values that can be obtained lessens, and it is not possible to perform fine correction on the transport error.

Note that, in the embodiment described above, the measurement pattern printed on the test sheet is lines (ruled lines) formed by the nozzle #90, but it is not limited thereto.

For example, lines that form the measurement pattern can be formed using a different nozzle. However, the nozzle #90 is a nozzle that is at the most upstream side in the transport direction, and as in the above described embodiment if the lines are formed with the nozzle #90, the number of lines of the measurement pattern that can be formed in the NIP state increases, and more correction values can be obtained, and the DC component transport error can be finely corrected.

Further, the measurement pattern can be formed as a block-shaped pattern using a plurality of nozzles and not as a line-shaped pattern. In short, it is only necessary that a distance can be detected between a pattern formed before transporting the paper by 1 inch, and a pattern formed after transporting the paper by 1 inch.

(6) By the way, in the nozzles #1 to #90, the ink ejection characteristics and ejection direction are respectively different. For this reason, supposing two lines are formed by different nozzles respectively, the interval between these two lines will reflect not only the transport error during the transport operation carried out between forming the two lines but also characteristic differences between the two nozzles. When the correction values Ca are calculated based on the interval between these two lines, the transport error cannot be accurately corrected.

Consequently, in the foregoing embodiment, the lines L1 to L20 of the measurement pattern are formed by the same nozzle (nozzle #90).

However, if the differences in nozzle characteristics can be ignored, the two lines may be formed by different nozzles.

(7) Providing all of the structural elements of the foregoing embodiments allows all the effects to be attained and is therefore preferable. However, it is not necessary that all the aforementioned structural elements are provided. For example, supposing that the white space amount calculations of S135 (see FIG. 13) are not carried out, it is still possible to correct the DC component transport error although the accuracy of the corrections is reduced.

(8) It should be noted that the description of the foregoing embodiments includes not only description of an inkjet printer, which is a recording apparatus, but also includes description of a transport method for transporting a medium such as the paper S. And with the above-described transport method, accurate corrections can be performed according to the transport amount, on DC component transport error, which fluctuates in response to the relative positions of the paper S and the head 41.

What is claimed is:

1. A recording apparatus comprising:

a head;

a transport mechanism that transports a medium in a transport direction with respect to the head, according to a target transport amount;

a memory that stores a plurality of correction values associated with a relative position of the head and the medium; and a controller that controls the transport mechanism based on the target transport amount that has been corrected, after correcting the target transport amount based on correction values, which are in number according to a size of the target transport amount, and which include the correction value according to the relative position when transporting by the target transport amount;

wherein each correction value is associated with a range of the relative position to be applied with that correction value, and the controller corrects the target transport amount by assigning weights to the correction value according to a ratio of a range of the relative position that changes when transporting by the target transport amount to the range of the relative position to be applied with the correction value.

2. A recording apparatus according to claim 1, wherein each correction value is associated with a range of the relative position to be applied with that correction value, and in a case where the range of the correction value corresponding to the relative position before transport is exceeded when transporting by the target transport amount, the controller corrects the target transport amount, based on the correction value corresponding to the relative position before transport and the correction value corresponding to the relative position after transport.

3. A recording apparatus according to claim 1, wherein the transport mechanism has a transport roller, and transports the medium in the transport direction by rotating the transport roller, each correction value is determined based on a transport error when transporting the medium by making the transport roller rotate by one rotation, and a range of the relative position to be applied with the correction value corresponds to a transport amount when transporting the medium by making the transport roller rotate by a rotation amount of less than one rotation.

4. A recording apparatus according to claim 1, wherein the transport mechanism has a transport roller, and transports the medium in the transport direction by making the transport roller rotate, before the correction value is stored in the memory, the controller prints a first pattern on a medium, prints a second pattern after transporting the medium by making the transport roller rotate by a rotation amount of less than one rotation from a rotating position of the transport roller at the time of printing the first pattern, prints a third pattern after transporting the medium by making the transport roller rotate by a rotation amount of one rotation from a rotating position of the transport roller at the time of printing the first pattern, and prints a fourth pattern after transporting the medium by making the transport roller rotate by a rotation amount of one rotation from a rotating position of the transport roller at the time of printing the second pattern, the memory stores a first correction value that has been determined based on the first pattern and the third pattern, and a second correction value that has been determined based on the second pattern and the fourth pattern, after the correction values have been stored in the memory, the controller transports a medium by correcting the target transport amount based on the first correction value, when a relative position of the medium with respect to the transport roller is in a predetermined range between the relative position at the time of printing the first pattern and the relative position at the time of printing the third pattern, and transports a medium by correcting the target transport amount based on the second correction value, in a state where a transport roller has been made to rotate by a rotation amount of less than one rotation from when a relative position of a medium with respect to the transport roller is in the predetermined range.

5. A recording apparatus according to claim 4, wherein the first pattern to the fourth pattern are formed using a same nozzle among a plurality of nozzles that move in the movement direction.

6. A recording apparatus according to claim 1, wherein the controller determines whether or not to perform correction of the target transport amount based on the correction values, which are in number according to a size of the target transport amount, based on a print mode that has been selected.

7. A transport method that transports a medium by correcting a target transport amount based on a correction value, the transport method comprising:

storing in advance in a memory a plurality of correction values each associated with a relative position of the head and the medium;

correcting a target transport amount based on correction values, which are in number according to a size of the target transport amount, and which include the correction value according to the relative position when transporting by the target transport amount; and transporting the medium based on the target transport amount that has been corrected;

wherein each correction value is associated with a range of the relative position to be applied with that correction value, and the correcting the target transport amount comprises assigning weights to the correction value according to a ratio of a range of the relative position that changes when transporting by the target transport amount to the range of the relative position to be applied with the correction value.

8. A transport method according to claim 7, wherein a transport mechanism transports the medium based on the target transport amount that has been corrected, the transport mechanism has a transport roller, and transports the medium in the transport direction by making the transport roller rotate, the transport method further comprising:

before storing the correction value in the memory, printing a first pattern on a medium, printing a second pattern after transporting the medium by making the transport roller rotate by a rotation amount of less than one rotation from a rotating position of the transport roller at the time of printing the first pattern, printing a third pattern after transporting the medium by making the transport roller rotate by a rotation amount of one rotation from a rotating position of the transport roller at the time of printing the first pattern, and printing a fourth pattern after transporting the medium by making the transport roller rotate by a rotation amount of one rotation from a rotating position of the transport roller at the time of printing the second pattern, storing a first correction value that has been determined based on the first pattern and the third pattern, and a second correction value that has been determined based on the second pattern and the fourth pattern, after the correction values have been stored in the memory, transporting a medium by correcting the target transport amount based on the first correction value, when a relative position of the medium with respect to the transport roller is in a predetermined range between the relative position at the time of printing the first pattern and the relative position at the time of printing the third pattern, and transporting a medium by correcting the target transport amount based on the second correction value, in a state where a transport roller has been made to rotate by a rotation amount of less than one rotation from when a relative position of a medium with respect to the transport roller is in the predetermined range.

9. A transport method according to claim 8,

P wherein the first pattern to the fourth pattern are formed using a same nozzle among a plurality of nozzles that move in the movement direction.

10. A transport method that transports a medium after correcting a target transport amount based on a correction value, the transport method comprising:

calculating a plurality of first correction values each associated with a relative position of the head and the medium;

storing in a memory second correction values each associated with a target transport amount, by calculating the second correction values, with respect to each target transport amount of a plurality of target transport amounts set in advance, based on the first correction values, which are in number according to a size of the target transport amount, and which include the first correction value according to the relative position when transporting by that target transport amount;

correcting the target transport amount based on the second correction value corresponding to the target transport amount, when transporting by that target transport amount; and transporting the medium based on the target transport amount that has been corrected;

wherein each of the first correction values are associated with a range of the relative position to be applied with that first correction value, and the correcting the target transport amount comprises assigning weights to the first correction value according to a ratio of a range of the relative position that changes when transporting by the target transport amount and the range of the relative position that is to be applied with the correction value, and calculating the second correction value.

11. A recording apparatus according to claim 10, wherein each first correction value is associated with a range of the relative position to be applied with that first correction value, and in the case where the range of the first correction value corresponding to the relative position before transporting is exceeded when transporting by the target transport amount, the controller calculates the second correction value, based on the first correction value corresponding to the relative position before transporting and the first correction value corresponding to the relative position after transporting.

12. A transport method according to claim 10, wherein the transport mechanism has a transport roller, and transports the medium in a transport direction by making the transport roller rotate, each first correction value is determined based on a transport error when transporting the medium by making the transport roller rotate once, and the range of the relative position to be applied with the first correction value corresponds to a transport amount when transporting the medium by making the transport roller rotate by a rotation amount of less than one rotation.

13. A transport method according to claim 10, wherein the transport mechanism has a transport roller, and transports the medium in the transport direction by making the transport roller rotate, the method further comprising:

when calculating the first correction value:

printing a first pattern on a medium;

printing a second pattern after transporting the medium by making the transport roller rotate by a rotation amount of less than one rotation from a rotating position of the transport roller at the time of printing the first pattern;

printing a third pattern after transporting the medium by making the transport roller rotate by a rotation amount of one rotation from a rotating position of the transport roller at the time of printing the first pattern;

printing a fourth pattern after transporting the medium by making the transport roller rotate by a rotation amount of one rotation from a rotating position of the transport roller at the time of printing the second pattern; and calculating a certain first correction value based on the first pattern and the third pattern, and calculating a different first correction value based on the second pattern and the fourth pattern, and when calculating the second correction value:

calculating the second correction value with respect to a certain target transport amount based on the certain first correction value, when a relative position of a medium with respect to the transport roller when transporting a medium by the certain target transport amount is in a predetermined range between the relative position at the time of printing the first pattern and the relative position at the time of printing the third pattern, and calculating the second correction value with respect to a different target transport amount based on the different first correction value, in a state that the transport roller is rotated by a rotation amount of less than one rotation from when a relative position of a medium with respect to the transport roller when transporting a medium by that target transport amount is in the predetermined range.

14. A transport method according to claim 13, wherein the first pattern to the fourth pattern are formed using a same nozzle of a plurality of nozzles that move in the transport direction.

15. A transport method according to claim 10, further comprising the step of determining whether or not to perform correction of the target transport amount based on the second correction value based on a print mode that has been selected.

16. A recording apparatus comprising:

a head;

a transport mechanism that transports a medium in a transport direction with respect to the head, according to a target transport amount; and a controller that controls the transport mechanism based on the target transport amount that has been corrected, after correcting the target transport amount, with second correction values calculated based on first correction values, which are in number according to a size of the target transport amount, and which include the first correction value associated with a relative position of the head and the medium when transporting by the target transport amount;

wherein each of the first correction values are associated with a range of the relative position to be applied with that first correction value, and the controller assigns weights to the first correction value according to a ratio of a range of the relative position that changes when transporting by the target transport amount and the range of the relative position that is to be applied with the correction value, and calculates the second correction value.

17. A recording apparatus according to claim 16, wherein the transport mechanism has a transport roller, and transports the medium in the transport direction by making the transport roller rotate, when calculating the first correction value, the controller prints a first pattern on a medium, prints a second pattern after transporting the medium by making the transport roller rotate by a rotation amount of less than one rotation from a rotating position of the transport roller at the time of printing the first pattern, prints a third pattern after transporting the medium by making the transport roller rotate by a rotation amount of one rotation from a rotating position of the transport roller at the time of printing the first pattern, and prints a fourth pattern after transporting the medium by making the transport roller rotate by a rotation amount of one rotation from a rotating position of the transport roller at the time of printing the second pattern, calculates a certain first correction value based on the first pattern and the third pattern, and calculates a different first correction value based on the second pattern and the fourth pattern, when calculating the second correction value, the controller calculates the second correction value with respect to a certain target transport amount based on the certain first correction value, when a relative position of a medium with respect to the transport roller when transporting a medium by the certain target transport amount is in a predetermined range between the relative position at the time of printing the first pattern and the relative position at the time of printing the third pattern, and calculates the second correction value with respect to a different target transport amount based on the different first correction value, in a state that the transport roller is rotated by a rotation amount of less than one rotation from when a relative position of a medium with respect to the transport roller when transporting a medium by that target transport amount is in the predetermined range.

18. A recording apparatus according to claim 17, wherein the first pattern to the fourth pattern are formed using a same nozzle of a plurality of nozzles that move in the transport direction.

* * * * *